US005796223A

United States Patent [19]

Ohtsuka et al.

[11] Patent Number: 5,796,223

[45] Date of Patent: Aug. 18, 1998

[54] METHOD AND APPARATUS FOR HIGH-SPEED DRIVING OF ELECTROMAGNETIC LOAD

[75] Inventors: Masuhiro Ohtsuka; Hiromi Kono; Tsuneo Adachi, all of Higashimatsuyama, Japan

[73] Assignee: Zexel Corporation, Tokyo, Japan

[21] Appl. No.: 884,501

[22] Filed: Jun. 27, 1997

[30] Foreign Application Priority Data

| | | | |
|---|---|---|---|
| Jul. 2, 1996 | [JP] | Japan | 8-189919 |
| Jul. 2, 1996 | [JP] | Japan | 8-189920 |
| Jul. 26, 1996 | [JP] | Japan | 8-214110 |

[51] Int. Cl.[6] ..... H01F 7/08; H01F 7/18

[52] U.S. Cl. ..... 318/126; 361/152; 361/155; 318/134

[58] Field of Search ..... 318/126, 127, 318/134; 361/139, 143, 144, 152, 153, 154, 155, 156; 335/209; 251/129.09

[56] References Cited

U.S. PATENT DOCUMENTS

| | | | |
|---|---|---|---|
| 3,982,505 | 9/1976 | Rivere . | |
| 4,310,868 | 1/1982 | Lillie et al. . | |
| 4,511,945 | 4/1985 | Nielsen . | |
| 4,679,116 | 7/1987 | Oshizawa et al. . | |
| 5,402,303 | 3/1995 | Luck et al. | 361/172 |

FOREIGN PATENT DOCUMENTS

| | | |
|---|---|---|
| 57-27301 | 5/1982 | Japan . |
| 63-36044 | 2/1988 | Japan . |
| 4-500399 | 1/1992 | Japan . |
| 6-26589 | 2/1994 | Japan . |

*Primary Examiner*—Bentsu Ro

*Attorney, Agent, or Firm*—Law Offices Pollock, Van Sande & Priddy

[57] ABSTRACT

An apparatus for driving an electromagnetic load by applying a high voltage at the initial driving stage and thereafter applying a constant hold current is provided with a switch for supplying high-voltage energy to the electromagnetic load from a capacitor for storing high-voltage energy and a control circuit responsive to an electric signal for starting electromagnetic load driving and the output voltage of the capacitor. The control circuit turns the switch on at application of the electric signal and keeps it on until the output voltage reaches a prescribed level. The apparatus of this configuration enables optimum timing of changeover from high-voltage application mode operation to hold mold operation with simple circuitry.

20 Claims, 14 Drawing Sheets

METHOD AND APPARATUS FOR HIGH-SPEED DRIVING OF ELECTROMAGNETIC LOAD

BACKGROUND OF THE INVENTION

1. Field of the Invention

The present invention relates to a method and an apparatus for driving an electromagnetic load which enable high-speed operation of an electromagnetic load including an inductive element, e.g., a solenoid valve, more particularly to an electromagnetic load driving method and apparatus wherein a high voltage stored in a capacitor is applied to the electromagnetic load at the initial driving stage, the electromagnetic load is thereafter applied with a constant hold current to maintain the electromagnetic load in a steady operating state, and when driving of the electromagnetic load is terminated the electromagnetic load is counter-excited to rapidly extinguish residual magnetic flux, thereby shortening the operation recovery time of the electromagnetic load.

2. Prior Art

Japanese Patent Application Public Disclosure No. Hei 6-26589 teaches a method for bringing an electromagnetic load, for example, a solenoid valve including an electromagnetic solenoid (an inductive element), up to its rated excitation state as quickly as possible by initially driving it in a high-voltage application mode in which high voltage is applied to the electromagnetic load for a short time period and then switching to a hold mode in which the excited load is held in a steady operating state with minimal energy consumption. On the other hand, it is a well known practice to pass reverse current through a solenoid valve at the time of terminating its operation to thereby rapidly extinguish residual magnetic flux and bring the operation of the solenoid valve to a quick halt.

FIG. 16 is a schematic diagram showing a prior-art solenoid valve driving apparatus which achieves high-speed solenoid valve driving by utilizing the method of applying high voltage to quickly operate the solenoid valve at the initial driving stage, and, at the time of terminating the operation, rapidly stopping the solenoid valve by applying counter-excitation. In FIG. 16, reference numeral 501 designates the solenoid coil of a solenoid valve 500. 502 designates a high-voltage supply unit having an energy-storage capacitor for storing high voltage, 503 designates a hold-current supply unit for supplying the solenoid coil 501 with hold current sufficient to hold the solenoid valve 500 in the operating state, and 504 designates a reverse current supply unit for supplying the solenoid coil 501 of the solenoid valve 500 with current for counter-excitation. Reference numeral 505 designates a control signal generating unit constituted as a circuit responsive to a drive signal a indicated in FIG. 17 for producing a first control signal b for controlling the high-voltage supply unit 502, a second control signal c for controlling the hold-current supply unit 503, and a third control signal d for controlling the reverse current supply unit 504 (see FIGS. 17 (B), (C) and (D)).

The prior-art configuration shown in FIG. 16 can conduct the required solenoid valve driving operation by using the first to third control signals b, c and d output from the control signal generating unit 505 to successively operate the supply units 502–504 each for the required time period. The configuration shown in FIG. 16 is disadvantageous, however, since the need for the control signal generating unit 505 in addition to the supply units 502–504 makes the apparatus large in size. Moreover, the configuration shown in FIG. 16 is for driving a single solenoid valve. When driving of multiple solenoid valves is necessary, the size of the apparatus becomes still larger and also markedly more expensive.

The apparatus also requires means to cope with the problem that, depending on the time point at switching from high-voltage application mode to hold mode occurs, the peak current may rise to greater than that required by the electromagnetic load, which increases the energy loss, or, conversely, may not reach the required level, which makes rapid operation impossible. Techniques for overcoming this problem include that of Japanese National-Publication-of-translated-version No. 4-500399, which teaches a configuration for controlling the time period during which the peak current flows, and that of Japanese Patent Application Publication No. Sho 63-36044, which teaches a configuration for detecting the peak current using a current detection resistor provided in series with the electromagnetic load and shifting to the hold mode when the detected peak current exceeds a prescribe value.

The former is very difficult to implement in actual practice, however, because variance in the reactance component and resistance component of the electromagnetic load and in the high-voltage has to be taken in consideration to achieve time period control capable of optimizing the length of the high-voltage application mode period. The latter is not a satisfactory solution because the resistor that has to be connected in series with the electromagnetic load for current detection produces an energy loss.

Japanese Patent Publication No. Sho 57-27301 teaches a counter-excitation method for shorting electromagnetic load recovery time which includes the steps of storing a charge in a capacitor in advance and passing the electric charge stored in the capacitor in the opposite direction from that in normal driving of the electromagnetic load to counter-excite the electromagnetic load and rapidly extinguish residual magnetic flux. This prior-art technique adopts a circuit in which a series connection of a high-voltage generating coil for charging the capacitor and a reverse current preventing diode is connected in parallel with the capacitor. Energy stored in the high-voltage generating coil is transferred to the capacitor by passing current through the high-voltage generating coil for a fixed time period and then cutting off the supply of current.

The configuration has the drawback that the voltage of the capacitor charge varies from time to time because variation in the physical constants of the high-voltage generating coil caused by temperature fluctuation, variation in voltage and the like produce changes in the current flowing through the high-voltage generating coil. Since this variation in the charge voltage varies the magnetic flux extinguishing current through the electromagnetic load, the electromagnetic load recovery time is irregular. Therefore, in the case of controlling the solenoid valve of an engine fuel injection valve, for example, the quantity of fuel injected cannot be accurately controlled.

SUMMARY OF THE INVENTION

One object of the present invention is therefore to provide a method and an apparatus for driving an electromagnetic load which overcome the problems of the prior art set forth in the foregoing.

Another object of the invention is to provide a method and an apparatus for driving an electromagnetic load which without use of special hardware for generating multiple control signals can control the driving of an electromagnetic load so as to apply high voltage to quickly operate the electromagnetic load at the initial driving stage, thereafter shift to a constant current driving state, and, at the time of terminating driving of the electromagnetic load, apply counter-excitation to quickly stop the operation of the electromagnetic load.

Another object of the invention is to provide an apparatus for driving an electromagnetic load which by a simple circuit optimally controls the length of a high-voltage driving period at the initial driving stage of the electromagnetic load.

Another object of the invention is to provide an apparatus for driving an electromagnetic load wherein the charge voltage of a capacitor for storing electrical energy for counter-excitation is maintained at a prescribed value irrespective of changes in temperature, battery voltage and the like, thereby ensuring uniform recovery time at the time of terminating operation of the electromagnetic load and enabling accurate drive control of the electromagnetic load.

In accordance with one aspect of the invention, there is provided a method for driving an electromagnetic load by, in response to a given control pulse signal, applying high voltage to the electromagnetic load at an initial driving stage to quickly operate the electromagnetic load, thereafter shifting to a constant current driving state, and applying counter-excitation to the electromagnetic load upon terminating driving thereof, the method comprising the steps of: in response to the control pulse signal, applying high voltage to the electromagnetic load for a prescribed time period starting from a leading edge time point of the control pulse signal; in response to a back electromotive force produced in the electromagnetic load upon cut-off of the application of the high voltage to the electromagnetic load, supplying the electromagnetic load with a constant current required for holding operation of the electromagnetic load until a trailing edge time point of the control pulse signal; using the back electromotive force produced in the electromagnetic load to store electrical energy in energy storage means; and in response to the control pulse signal, starting to supply electrical energy stored in the energy storage means to the electromagnetic load as counter-excitation current at the trailing edge time point of the control pulse signal.

In accordance with another aspect of the invention, there is provided an apparatus for driving an electromagnetic load which is provided on a high side of the electromagnetic load, one terminal of which is connected to ground, and is responsive to a given control pulse signal for quickly operating the electromagnetic load by high voltage application in an initial driving stage, thereafter shifting to a constant current driving state, and effecting counter-excitation upon termination of driving, the apparatus comprising: a high-voltage supply section for producing high voltage for application to the electromagnetic load; a high-voltage application control circuit responsive to the control pulse signal for controlling the high-voltage supply section to cause it to apply high voltage to the electromagnetic load for a prescribed time period starting from a leading edge time point of the control pulse signal; a hold current supply section responsive to a back electromotive force produced in the electromagnetic load upon cut-off of the high voltage applied to the electromagnetic load by the high-voltage supply section for starting supply of operation hold current to the electromagnetic load and continuing the supply thereof until a trailing edge time point of the control pulse signal, thereby effecting constant current driving of the electromagnetic load; an energy storage circuit for storing electrical energy using the back electromotive force produced in the electromagnetic load; and a counter-excitation current supply control circuit responsive to the control pulse signal for starting supply of electrical energy stored in the energy storage circuit to the electromagnetic load as counter-excitation current at the trailing edge time point of the control pulse signal.

With this configuration, the high-voltage application control circuit operates at the leading edge time point of the applied control pulse signal to apply the electromagnetic load with high voltage from the high-voltage supply section. This quickly operates the electromagnetic load. When the application of the high voltage to the electromagnetic load is stopped, back electromotive force is produced in the electromagnetic load. The hold current supply section starts operation in response to the back electromotive force to supply the electromagnetic load with hold current for holding the required operation thereof. The hold current drives the electromagnetic load with constant current. The supply of hold current continues until the trailing edge time point of the control pulse signal. At the trailing edge time point of the control pulse signal, the supply of hold current to the electromagnetic load is terminated and the counter-excitation current supply control circuit responds to the trailing edge of the control pulse signal by supplying counter-excitation current to the electromagnetic load from the energy storage circuit. This quickly stops the operation of the electromagnetic load.

In accordance with another aspect of the invention, there is provided a method for driving an electromagnetic load by applying high voltage to the electromagnetic load for a prescribed time period to drive it at an initial driving stage thereof, thereafter reducing current passing through the electromagnetic load, supplying flywheel current to the electromagnetic load from a flywheel circuit from the time of cut-off of current supply to the electromagnetic load at the end of the prescribed time period to the time of terminating electromagnetic load driving, charging a capacitor using self-induced energy produced in the electromagnetic load by the cut-off of current supply to the electromagnetic load, and applying charge voltage of the capacitor to the electromagnetic load for counter-exciting the electromagnetic load upon terminating driving thereof, the method comprising the steps of effecting control based on the absolute value of the charge voltage of the capacitor after the driving of the electromagnetic load by application of high voltage terminates to stop the supply of flywheel current to the electromagnetic load by the flywheel circuit and charge the capacitor by the self-induced energy produced in the electromagnetic load when the absolute value of the charge voltage of the capacitor becomes equal to or less than a prescribed value and to conduct supply of flywheel current to the electromagnetic load by the flywheel circuit and disable charging of the capacitor when the absolute value of the charge voltage of the capacitor becomes greater than the prescribed value.

In accordance with another aspect of the invention, there is provided an apparatus for driving an electromagnetic load comprising: a current control section for on/off controlling current flowing through the electromagnetic load to drive the electromagnetic load with a required constant current; a flywheel circuit for supplying flywheel current to the electromagnetic load when supply of current to the electromagnetic load is turned off by the current control section; and a counter-excitation circuit which includes a capacitor charged by self-induced energy produced in the electromagnetic load by cut-off of driving current to the electromagnetic load and applies the charge voltage of the capacitor to the electromagnetic load for counter-excitation of the electromagnetic load upon terminating driving of the electromagnetic load; the supply of flywheel current to the electromagnetic load by the flywheel circuit being stopped and the capacitor being charged when the absolute value of the charge voltage of the capacitor becomes equal to or less than a prescribed value and supply of flywheel current to the electromagnetic load by the flywheel circuit being conducted and charging of the capacitor being disabled when the absolute value of the charge voltage of the capacitor becomes greater than the prescribed value.

With this configuration, the current control section on/off controls the current passing through the electromagnetic load so as to drive the electromagnetic load. When the absolute value of the capacitor charge voltage is equal to or less than a prescribed value, the operation of the flywheel circuit is stopped. Charging of the capacitor is therefore enhanced since the self-induced energy produced in the electromagnetic load when the current therethrough is turned off is used for capacitor charging. When the absolute value of the capacitor charge voltage is larger than the prescribed value, the flywheel circuit operates and no charging of the capacitor is conducted using self-induced energy produced in the electromagnetic load owing to cut-off of current supplied thereto. As a result, the charging voltage supplied to the capacitor is substantially constant so that the counter-excitation of the electromagnetic load by the charge voltage can always be effected stably under the same electrical conditions.

The flywheel circuit can be constituted to include a flywheel diode, a switching device for on/off controlling current flowing through the flywheel diode, and a flywheel control circuit for on/of controlling the switching device. In this case, a configuration can be adopted wherein the flywheel control circuit turns the switching circuit on only when the absolute value of the voltage of the capacitor for counter-excitation is larger than a prescribed value and the back electromotive force produced in the electromagnetic load during on/off operation for adjusting the mean value of the current flowing through the electromagnetic load is used to charge the capacitor for storing energy for counter-excitation.

In accordance with another aspect of the invention, there is provided an apparatus for driving an electromagnetic load which applies a high voltage to the electromagnetic load at an initial driving stage to operate the electromagnetic load at high speed and thereafter applies a hold current of required constant level to the electromagnetic load to hold it in a steady operating state, the apparatus comprising: a high-voltage supply section including a capacitor for storing high-voltage energy for the high-speed operation of the electromagnetic load; switching means provided between the capacitor and the electromagnetic load for supplying high-voltage energy from the capacitor to the electromagnetic load; and control circuit means responsive to an electric signal for starting electromagnetic load driving and the output voltage of the capacitor for controlling the switching means to turn on at application of the electric signal and remain on until the output voltage falls to a prescribed level.

Before application of the electrical signal to the apparatus for driving the electromagnetic load, the switching means is off and the electromagnetic load is in a deenergized state. When an electrical signal is input, the control circuit means responds thereto to turn the switching means on. The high-voltage energy stored in the capacitor is therefore supplied to the electromagnetic load through the switching means. Since the high-voltage energy is supplied from the capacitor in the manner of being discharged through the electromagnetic load, the output voltage from the capacitor gradually decreases with passage of time. When it has fallen to a prescribed level, the control circuit means responds by turning off the switching means. As a result, the electromagnetic load is driven at high speed in the initial driving stage. Thereafter the electromagnetic load is supplied with a prescribed constant current to be held in a steady operating state by low level current.

The invention will be better understood and other objects and advantages thereof will be more apparent from the following detailed description of preferred embodiments with reference to the accompanying drawings.

DETAILED DESCRIPTION OF THE PREFERRED EMBODIMENTS

Figure 1:
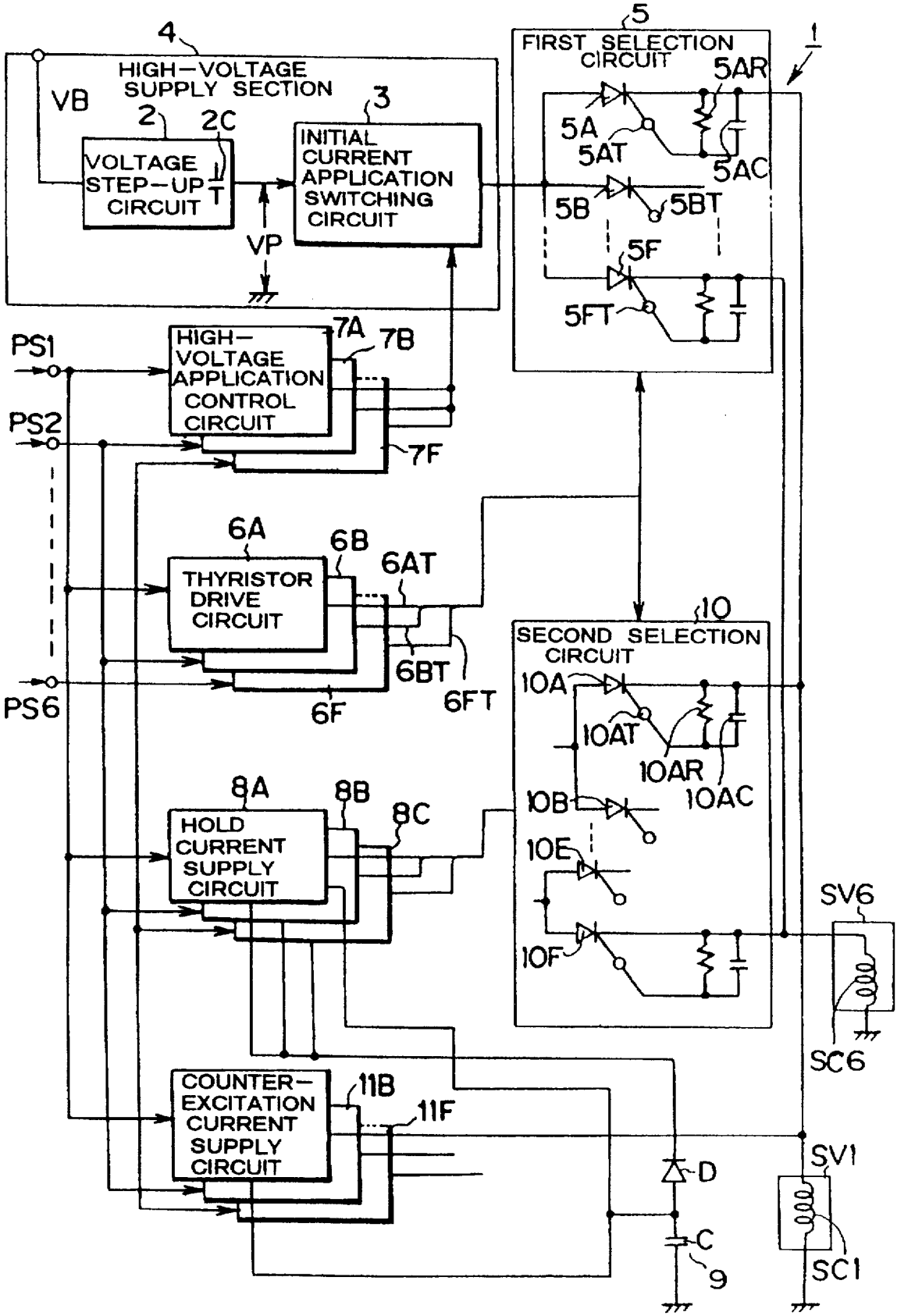
FIG. 1 is a block diagram showing a solenoid valve drive apparatus which is an embodiment of the invention.

FIG. 1 is a block diagram showing a solenoid valve drive apparatus 1 which is an embodiment of the invention. The solenoid valve drive apparatus 1 is disposed on the high side of the solenoid coils of multiple solenoid valves. At the initial driving stage, it rapidly operates each solenoid valve by applying high voltage to the solenoid coil (electromagnetic load). It then conducts constant current drive control for passing a prescribed constant current through the solenoid coil so as to hold the operation of the solenoid valve. Immediately following termination of the constant current drive control, it counter-excites the solenoid coil. The solenoid valve drive apparatus 1 of this embodiment is responsive to six control pulse signals PS1–PS6 to drive, in the foregoing manner, six corresponding solenoid valves SV1–SV6 of six fuel injection valves associated one with each of the cylinders of a six-cylinder internal combustion engine. FIG. 1 is simplified to show only two solenoid valves, SV1 and SV6, of the total of six solenoid valves.

Reference numeral 2 in FIG. 1 designates a voltage step-up circuit of conventional configuration which steps up a DC voltage VB from a DC power supply (not shown) to a high voltage VP of around 160 V and stores it in a capacitor 2C for output. Reference numeral 3 designates an initial current application switching circuit 3 for applying the high voltage VP from the voltage step-up circuit 2 to the solenoid coils SC1–SC6 of the solenoid valves SV1–SV6 at the initial stage of solenoid valve driving to pass required initial current therethrough. The voltage step-up circuit 2 and the initial current application switching circuit 3 together constitute a voltage supply section 4. The single voltage supply section 4 serves all 6 solenoid valves SV1–SV6 and selectively supplies the high voltage to the one solenoid valve currently selected by a first selection circuit 5.

The first selection circuit 5 includes six thyristors 5A–5F provided one in association with each of the solenoid coils SC1–SC6. The anodes of the thyristors 5A–5F are connected together and the cathodes thereof are connected to the high-side terminals of the solenoid coils SC1–SC6 of the associated solenoid valves SV1–SV6.

Six thyristor drive circuits 6A–6F are provided one in association with each of the thyristors 5A–5F. Each of the control pulse signals PS1–PS6 is input to a corresponding one of the thyristor drive circuits 6A–6F. The thyristor drive circuit 6A responds to the leading edge of the control pulse signal PS1 by simultaneously outputting a trigger signal 6AT to a trigger terminal 5AT of the thyristor 5A. Like the thyristor drive circuit 6A, the other thyristor drive circuits 6B–6F similarly respond to the leading edges of the control pulse signals PS2–PS6 by simultaneously outputting trigger signals 6BT–6FT to trigger terminals 5BT–5FT of the associated thyristors 5B–5F.

High-voltage application control circuits 7A–7F are provided one in association with each of the solenoid valves SV1–SV6. Their outputs are connected with each other and to the initial current application switching circuit 3, as explained further later. The high-voltage application control circuit 7A responds to the control pulse signal PS1 by turning the initial current application switching circuit 3 on for a prescribed time period starting from the leading edge time point of the control pulse signal PS1. Each of the high-voltage application control circuits 7B–7F similarly responds to the corresponding one of the control pulse signal PS2–PS6 by turning the initial current application switching circuit 3 on for a prescribed time period starting from the leading edge time point of the control pulse signal.

Reference numerals 8A–8C designate hold current supply circuits each associated with two solenoid valves which are not driven simultaneously. The hold current supply circuits 8A–8C are connected to an energy storage circuit 9 consisting of a diode D and a capacitor C. The energy storage circuit 9 is for storing electrical energy produced by back electromotive force arising in any of the solenoid coils and to be used for counter-excitation of the solenoid coils. Each of the hold current supply circuits 8A–8C detects whether or not charging current flowing into the capacitor C owing to back electromotive force generated in the solenoid coil of a solenoid valve associated therewith has exceeded a prescribed level, to thereby discriminate the presence/absence of back electromotive force in the solenoid coil, and when back electromotive force occurs, supplies hold current to the solenoid coil of the solenoid valve concerned through a second selection circuit 10 to hold the operation of the solenoid valve.

Like the first selection circuit 5, the second selection circuit 10 also comprises six thyristors (10A–10F) associated one with each of the solenoid valves SV1–SV6. The second selection circuit 10 differs from the first selection circuit 5, however, in that its thyristors are divided into thyristor pairs 10A–10B, 10C–10D and 10E–10F and one of the hold current supply circuits 8A, 8B and 8C is connected to both members of each pair.

Each of the hold current supply circuits 8A–8C responds to the corresponding control pulse signal by conducting constant current driving from the time of occurrence of back electromotive force in the solenoid coil to the trailing edge time point of the control pulse signal, specifically by supplying a prescribed constant current to the solenoid coil for holding the operation of the solenoid valve.

Reference numerals 11A–11F designate counter-excitation current supply circuits associated one with each of the solenoid valves SV1–SV6 and operative in response to the corresponding control pulse signals PS1–PS6. At the trailing edge time point of the corresponding control pulse signal, each of the counter-excitation current supply circuits 11A–11F applies the voltage stored in the capacitor C of the energy storage circuit 9 to the solenoid coil of the associated solenoid valve in the opposite direction from that during normal operation, thereby counter-exciting the solenoid coil.

The initial current application switching circuit 3, the high-voltage application control circuit 7A, the thyristor drive circuit 6A, the hold current supply circuit 8A and the counter-excitation current supply circuit 11A shown as blocks in FIG. 1 will now be explained with reference to FIGS. 2 to 6.

Figure 2:
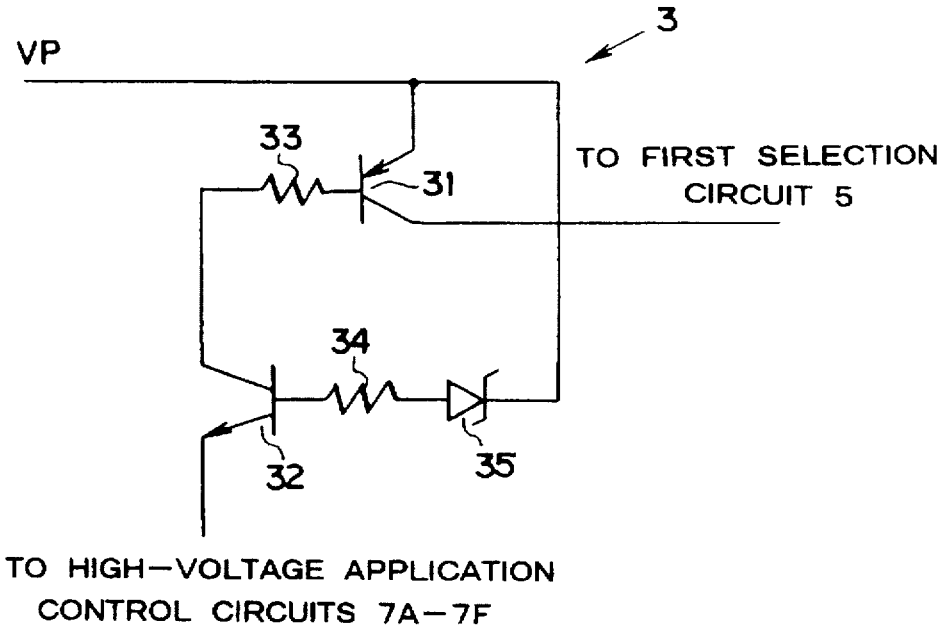
FIG. 2 is a detailed diagram of an initial current application switching circuit shown in FIG. 1.

FIG. 2 is a detailed diagram of the initial current application switching circuit 3. The initial current application switching circuit 3 comprises transistors 31, 32, resistors 33, 34 and a Zener diode 35 connected as shown. The emitter of the transistor 31 is applied with the high voltage VP and its collector is connected to the anodes of the thyristors 5A–5F of the first selection circuit 5. When the emitter voltage of the transistor 32 falls owing to the operation of any of the high-voltage application control circuits 7A–7F as explained later, the transistors 31, 32 both turn on to apply the high voltage VP to the anodes of the thyristors 5A–5F of the first selection circuit 5. The function of the Zener diode 35 is to turn off the base current flowing to the transistor 32 to automatically turn off the transistors 31, 32 when the high voltage VP falls below a prescribed value after the transistor 32 has once turned on. In this embodiment, the Zener voltage of the Zener diode 35 is 20 V.

Figure 3:
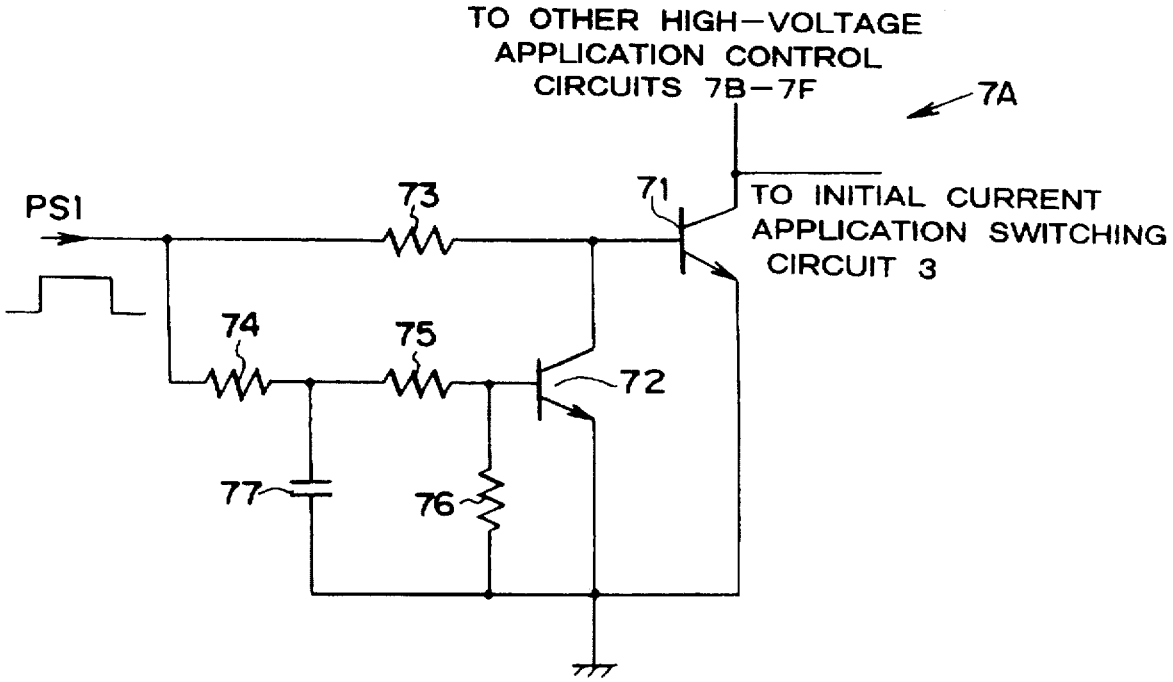
FIG. 3 is a detailed diagram of a high-voltage application control circuit shown in FIG. 1.

FIG. 3 is a detailed diagram of high-voltage application control circuit 7A. Reference numerals 71, 72 designate transistors, 73–76 resistors and 77 a capacitor. The resistor 74 and capacitor 77 constitute an integration circuit. Owing to the operation of this integration circuit, the base voltage of the transistor 72 reaches a prescribed level and the transistor 72 turns off when a prescribed period of time has passed following the leading edge time point of the control pulse signal PS1. The transistor 71 turned on at the leading edge time point of the control pulse signal PS1 therefore turns off when the transistor 72 turns on after passage of a time period determined by the time constant of the integration circuit constituted by the resistor 74 and the capacitor 77. The transistor 71 thus stays on for a fixed time period following application of the control pulse signal PS1 and the transistors 31, 32 of the initial current application switching circuit 3 to turn on owing to the resulting fall in the collector voltage of the transistor 71 (see FIG. 2).

As a result, the high voltage VP is forwarded through the transistor 31 to the first selection circuit 5 for a fixed time period following input of the control pulse signal PS1. Since, as will be shown later, the thyristor 5A associated with the control pulse signal PS1 is held on by the thyristor drive circuit 6A at this time, the high voltage VP is applied to the solenoid coil SC1 of the solenoid valve SV1. Initial current therefore flows through the solenoid coil SC1 to begin high-speed operation of the solenoid valve SV1. Since the high-voltage application control circuits 7B–7F are configured in substantially the same way as the high-voltage application control circuit 7A explained in the foregoing, they will not be explained in detail.

Figure 4:
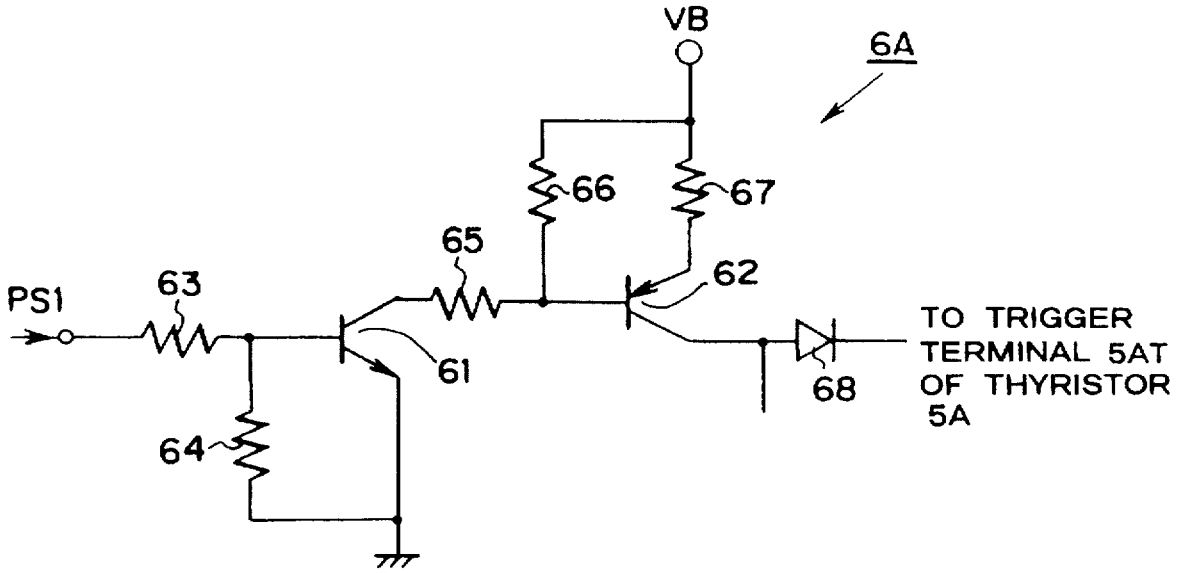
FIG. 4 is a detailed diagram of a thyristor drive circuit shown in FIG. 1.

FIG. 4 is a detailed diagram of the thyristor drive circuit 6A. Reference numerals 61, 62 designate transistors, 63–67 resistors and 68 a diode. When the level of the control pulse signal PS1 input to the thyristor drive circuit 6A becomes high, the transistor 61 turns on, the transistor 62 turns on, the anode voltage of the diode 68 becomes approximately equal to the DC voltage VB, and the trigger terminal 5AT of the associated thyristor 5A is brought to the high state required for making the thyristor 5A conductive. The thyristor 5A stays conductive until the control pulse signal PS1 falls to low level. Since the thyristor drive circuits 6B–6F are configured in substantially the same way as the thyristor drive circuit 6A explained in the foregoing, they will not be explained in detail.

Figure 5:
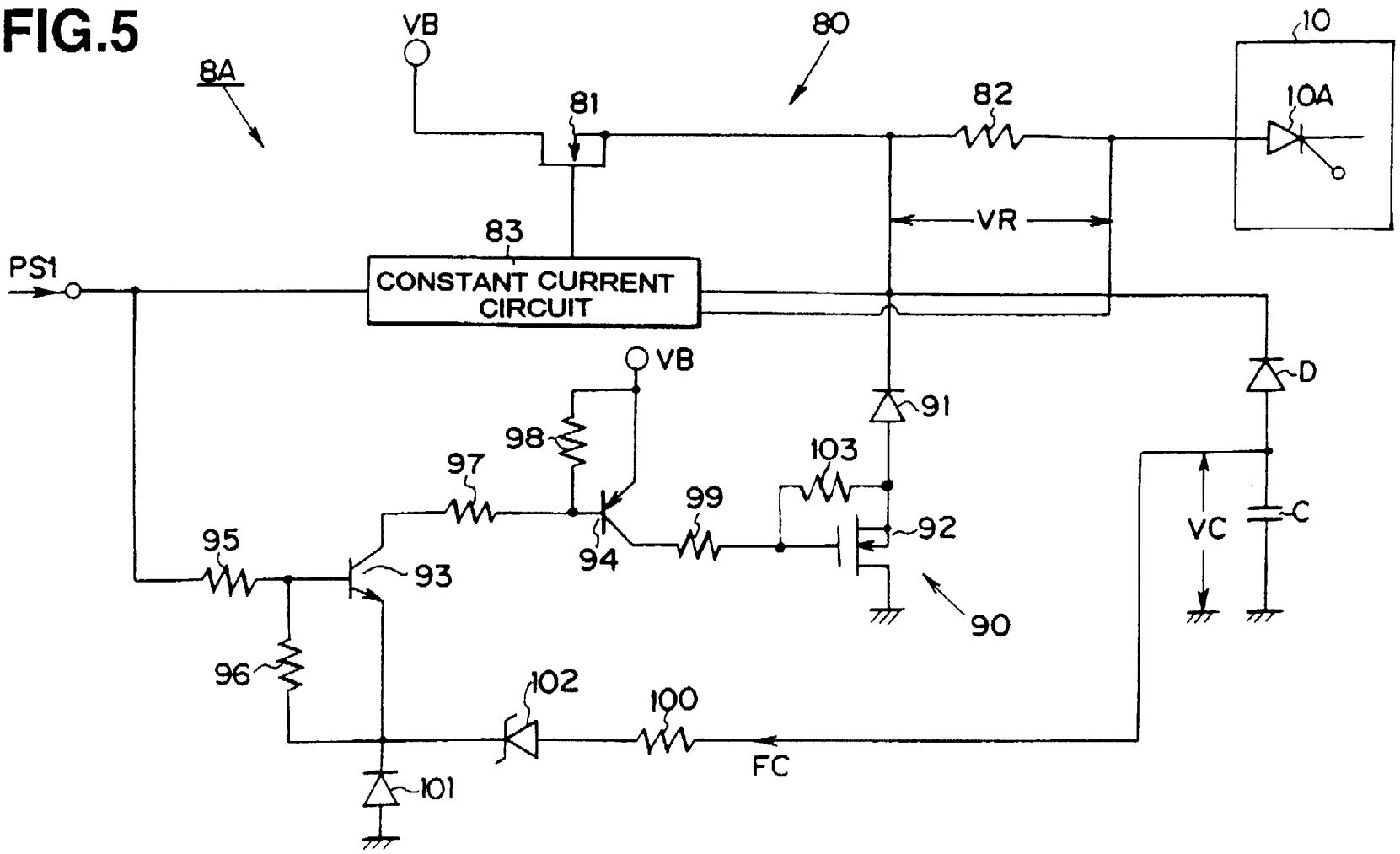
FIG. 5 is a detailed diagram of a hold current supply circuit shown in FIG. 1.

FIG. 5 is a detailed diagram of the hold current supply circuit 8A. The hold current supply circuit 8A consists of a constant current control section 80 and a flywheel circuit 90. The constant current control section 80 is connected in series with a switching transistor 81 and a current detection resistor 82. The DC voltage VB is applied to the associated thyristor 10A of the second selection circuit 10 through this series connection. When the thyristor 10A turns on, the current caused to pass through the associated solenoid coil SC1 owing to the application of the DC voltage VB also simultaneously flows through the current detection resistor 82. The detection voltage VR this produces across the current detection resistor 82 is input to a constant current circuit 83 as a detection signal indicative of the level of the solenoid current IS. During a constant current drive control period defined as explained later and falling within the period that the control pulse signal PS1 applied to the constant current circuit 83 is at high level, the constant current circuit 83 is responsive to the detection voltage VR to on/off control the switching transistor 81 in order to pass constant current required for driving the solenoid coil SC1 of the solenoid valve SV1.

The flywheel circuit 90 is for supplying flywheel current to the solenoid coil SC1 when the switching transistor 81 of the constant current control section 80 is off. Reference numeral 91 designates a flywheel diode, 92 a switching transistor for enabling/disabling passage of the flywheel current from the flywheel diode 91 through the solenoid coil SC1 of the solenoid valve SV1. Reference numerals 93 and 94 designate switching transistors, 95–100 resistors, 101 a diode, 102 a Zener diode and 103 a resistor. In this embodiment, the control pulse signal PS1 is applied through the resistor 95 to the base of the switching transistor 93, and the capacitor voltage VC, the voltage across the terminals of the capacitor C, is input to the flywheel circuit 90 as a flywheel control signal FC. The flywheel control signal FC is applied through the resistor 100 and the Zener diode 102 to the emitter of the switching transistor 93. The emitter of the switching transistor 93 is grounded through the diode 101.

With this configuration, unless the capacitor voltage VC is low (has a large negative value), the Zener diode 102 does not conduct and the switching transistor 93 does not become conductive. In other words, when the capacitor voltage VC is equal to or greater than a prescribed value of, say, −70 V, determined by the Zener voltage of the Zener diode 102, the switching transistor 93 remains off even when the control pulse signal PS1 is at high level so that the flywheel diode 91 cannot be put in conductive state to operate the flywheel circuit 90. On the other hand, when the level of the control pulse signal PS1 is high and the capacitor voltage VC is less than the prescribed level (e.g., −70 V), the switching transistors 93, 94 turn on, the switching transistor 92 becomes conductive, and flywheel current from the flywheel diode 91 flows through the solenoid coil SC1 of the solenoid valve SV1.

Thus when the level of the control pulse signal PS1 is high and a large back electromotive force arises in the solenoid coil SC1, thereby charging the capacitor C and causing the capacitor voltage VC to fall below the prescribed value, the hold current supply circuit 8A enables operation of the flywheel circuit 90 to conduct constant current driving of the solenoid coil SC1. The hold current supply circuit 8A also similarly conducts constant current driving of another solenoid valve (SV4, not shown) that is not constant-current driven simultaneously with the solenoid valve SV1. The hold current supply circuits 8B and 8C are configured in substantially the same way as the hold current supply circuit 8A explained in the foregoing.

Figure 6:
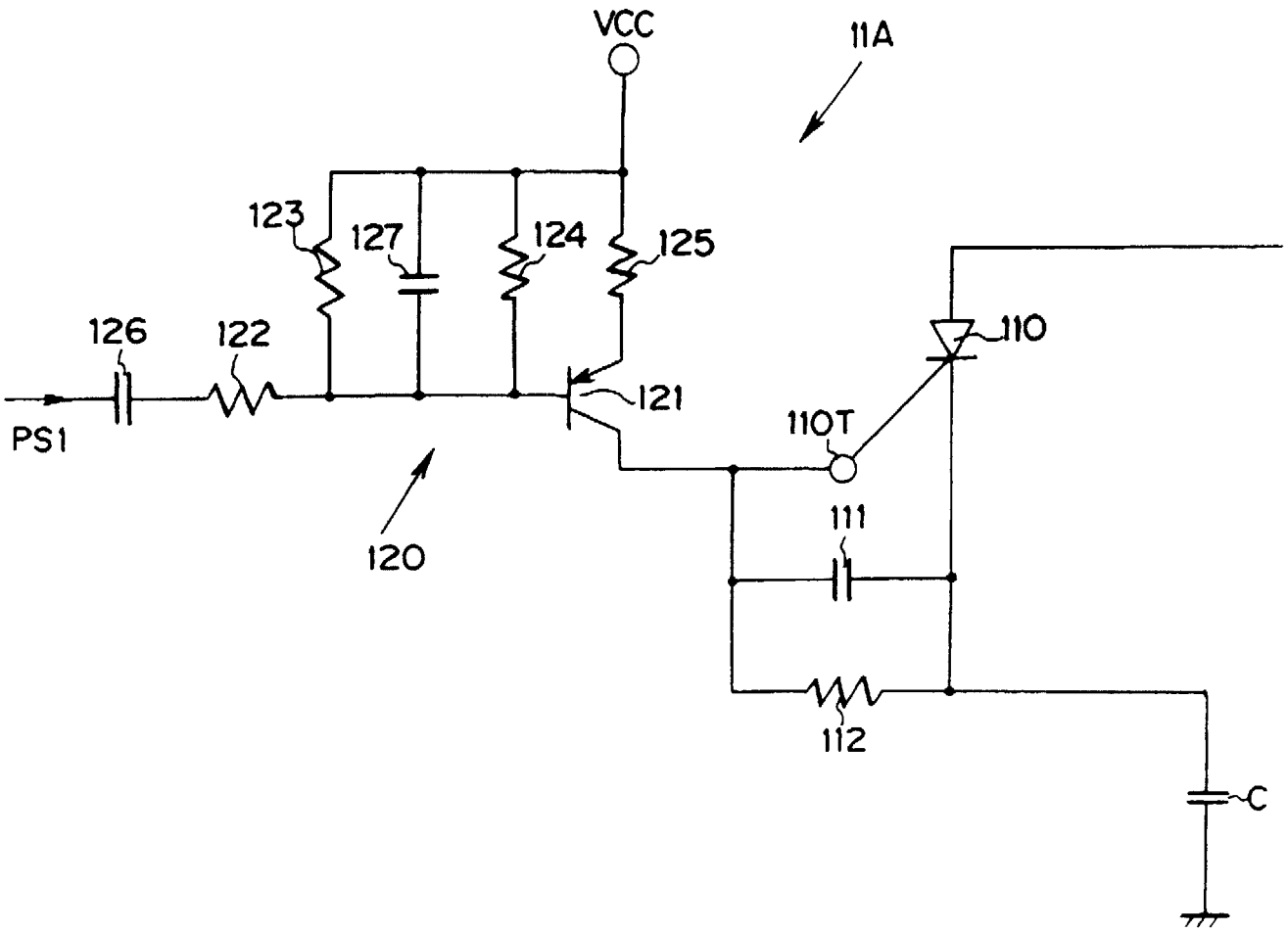
FIG. 6 is a detailed diagram of a counter-excitation current supply circuit shown in FIG. 1.

FIG. 6 is a detailed diagram of the counter-excitation current supply circuit 11A. The counter-excitation current supply circuit 11A includes a thyristor 110 having a capacitor 111 and a resistor 1123 connected in parallel between its trigger terminal 110T and cathode. The components collectively designated by reference numeral 120 constitute a trigger control circuit for applying a trigger signal to the thyristor 110 to make the thyristor 110 conductive at the trailing edge time point of the control pulse signal PS1. The trigger control circuit 120 consists of a transistor 121, resistors 122–125 and capacitors 126, 127 connected in the manner shown in the drawing. The control pulse signal PS1 is applied to the base of the transistor 121 through the capacitor 126 and the resistor 122. Since the input circuit of the transistor 121 is thus provided with a time constant circuit constituted by the capacitor 126 and the resistor 122 and with another time constant circuit constituted by the resistors 123, 124 and the capacitor 127, base current flows to the transistor 121 for a short time period after the trailing edge time point of the control pulse signal PS1, where the control pulse signal PS1 changes from high level to low level. The transistor 121 and, consequently, the thyristor 110 are therefore on during this period. As a result, the charge stored in the capacitor C flows through the thyristor 110 to pass through the solenoid coil SC1 in the opposite direction from that during normal operation, thereby counter-exciting the solenoid coil SC1. The hold current supply circuit 8A is stopped at the time this counter-excitation is effected. The counter-excitation current supply circuits 11B–11F are configured in substantially the same way as the counter-excitation current supply circuit 11A explained in the foregoing.

Figure 7:
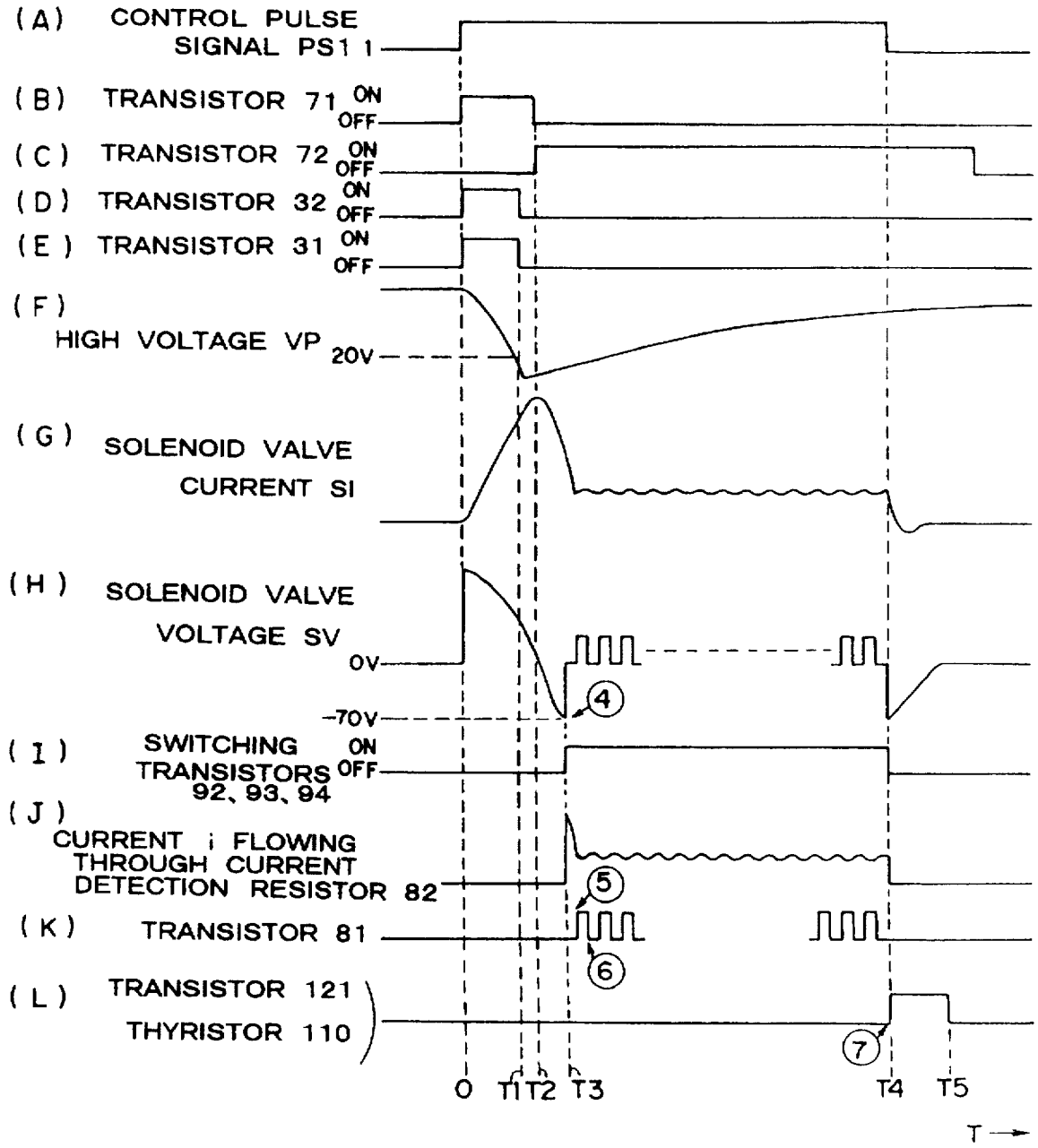
FIG. 7 is a diagram showing waveforms of signals at different portions of the solenoid valve drive apparatus shown in FIG. 1 for explaining the operation thereof.

The operation of the solenoid valve drive apparatus 1 shown in FIG. 1 will now be explained with reference to the waveform diagram of FIG. 7. The horizontal axis in FIG. 7 represents lapsed time T from the time point at which the control pulse signal PS1 rises from low level to high level (the leading edge of the control pulse signal PS1). When the control pulse signal PS1 rises from low level to high level at T=0, (FIG. 7 (A), the transistors 71, 32, 31 turn on (FIG. 7 (B), (D), (E)). Since the thyristor drive circuit 6A also operates at this time, the trigger signal 6AT is simultaneously applied to the trigger terminal 5AT of the thyristor 5A and the trigger terminal 10AT of the thyristor 10A. Since the time constant of the time constant circuit (capacitor 5AC and resistor 5AR) connected to the trigger terminal 5AT of the thyristor 5A is smaller than the time constant of the time constant circuit (capacitor 10AC and resistor 10AR) connected to the trigger terminal 10AT of the thyristor 10A, however, the thyristor 10A of the second selection circuit 10 invariably becomes conductive after the thyristor 5A of the first selection circuit 5 has become conductive. Although time constant circuits (resistors and capacitors) are shown for only some of the thyristors of the first selection circuit 5 and the second selection circuit 10 in the simplified FIG. 1, a time constant circuit (resistor and capacitor) is in fact provided for every thyristor of the first selection circuit 5 and the second selection circuit 10. The operation of the other thyristor pairs 5B and 10B, 5C and 10C, . . . is therefore the same as that of the thyristors 5A and 10A explained in the foregoing.

Therefore, although the high voltage VP is applied to the solenoid coil SC1 of the solenoid valve SV1 at T=0, the level of the high voltage VP gradually decreases with lapse of time owing to discharge of the high-voltage storage capacitor 2C provided in the voltage step-up circuit 2. When the high voltage VP has fallen to 20 V at T=T1, the transistors 32, 31 turn off. Owing to the integration operation of the resistor 74 and the capacitor 77 with respect to the control pulse signal PS1, the transistor 72 turns on and the transistor 71 turns off at T=T2 (FIG. 7 (B), (C)), thus terminating the initial driving operation of applying high voltage to the solenoid valve SV1. FIG. 7 (G), (H) show how the levels of the solenoid valve current SI flowing through the solenoid coil SC1 of the solenoid valve SV1 and the solenoid valve voltage SV applied to the solenoid coil SC1 change.

When the transistor 31 turns off, the level of the solenoid valve voltage SV falls rapidly. At the instant the solenoid valve voltage SV becomes negative, current is supplied to the solenoid valve from the capacitor C. At T=T3, when the solenoid valve voltage SV reaches the voltage defined by the Zener voltage of the Zener diode 102, −70 V in this embodiment, the switching transistors 93, 94 turn on (FIG. 7 (I)) and the solenoid coil SC1 is supplied with current i flowing from ground through the flywheel diode 91 and the current detection resistor 82 (FIG. 7 (J)). Since the current flowing through the solenoid coil SC1 at this time is equal to or greater than a prescribed value, the switching transistor 81 remains on.

However, between the time that the solenoid valve voltage SV reaches near zero and the time that the flywheel diode 91 begins to supply current, the constant current circuit 83 operates intermittently. Specifically, as soon as the switching transistor 81 turns on and current is supplied to the solenoid coil SC1 through the current detection resistor 82, the switching transistor 81 immediately turns back off since the current flowing through solenoid coil SC1 is already at or above the prescribed level. This operation occurs repeatedly.

When the current flowing through the solenoid coil SC1, i.e., the solenoid valve current SI, falls to or below a prescribed level, the switching transistor 81 turns on and the DC voltage VB is applied to the solenoid coil SC1. When this causes the solenoid valve current SI to become greater than the prescribed value, the switching transistor 81 is turned off by the constant current circuit 83 and the solenoid coil SC1 is supplied with current from ground through the flywheel diode 91. As shown by FIG. 7 (G), therefore, the level of the solenoid valve current SI is substantially held at a prescribed constant value to effect constant-current driving of the solenoid valve SV1.

When the control pulse signal PS1 changes from high level to low level at T=T4, the negative voltage produced in the solenoid coil SC1 of the solenoid valve SV1 at this time turns the transistor 121 and the thyristor 110 on. Then, after lapse of a prescribed time period, at T=T5, the transistor 121 and the thyristor 110 turn off. In the period T4<T<T5, the voltage charged in the capacitor C is applied through the transistor 121 to the solenoid coil SC1 in reverse polarity to effect counter-excitation of the solenoid coil SC1. Since the operation of the hold current supply circuit 8A was stopped owing to the fall of the control pulse signal PS1 to low level at T=T4, flywheel current does not flow. The discretely timed operations of the other solenoid valves SV2–SV6 are identical with that of the solenoid valve SV1 and will not be explained in detail.

Figure 16:
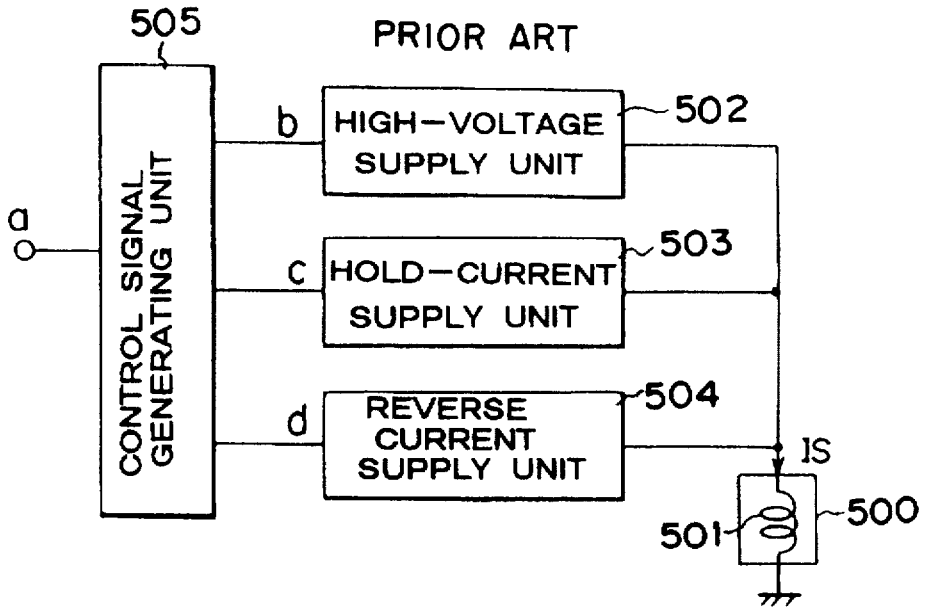
FIG.16 PRIOR ART
FIG. 16 is a block diagram showing the configuration of a prior-art solenoid valve drive apparatus.
Figure 17:
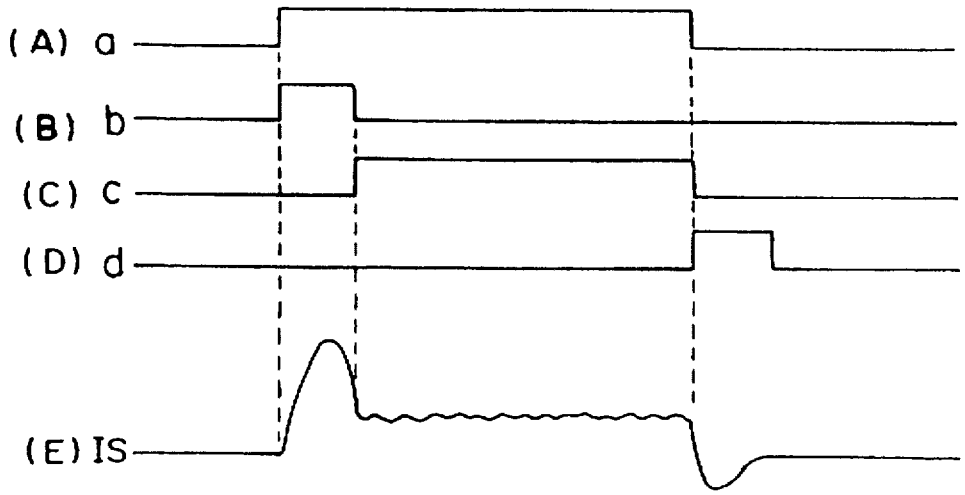
FIG.17 PRIOR ART
FIG. 17 is a diagram showing waveforms of signals at different portions of the prior-art solenoid valve drive apparatus shown in FIG. 16 for explaining the operation thereof.

As is clear from the foregoing explanation, mere application of the control pulse signal PS1 to the solenoid valve drive apparatus 1 enables the voltage supply section 4, the hold current supply circuit 8A and the counter-excitation current supply circuit 11A to operate interactively with optimum timing to effect, successively and with the required timing, the initial driving of the solenoid valve SV1 by the high voltage VP, the ensuing operation by supply of hold current, and the counter-excitation of the solenoid coil SC1 immediately after driving of the solenoid valve SV1 is terminated. Since the solenoid valve drive apparatus 1 therefore does not require a signal generating circuit corresponding to the control signal generating unit 505 of FIG. 16, it can be realized with a simpler circuit configuration.

Figure 8:
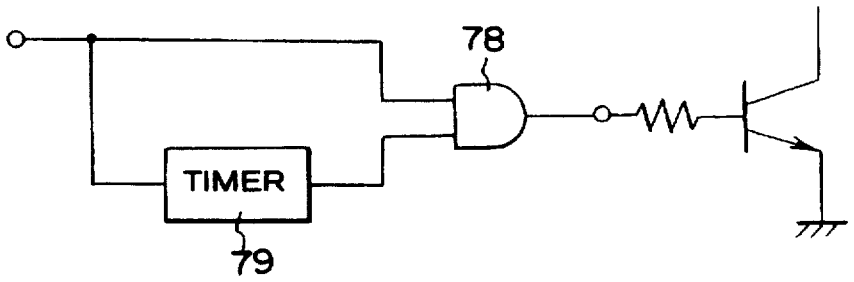
FIG. 8 is circuit diagram showing a modified version of the high-voltage application control circuit shown in FIG. 1.

Although the timing of the initial driving of the solenoid valve SV1 by the high voltage VP is controlled using a timer circuit, this timing circuit does not require high accuracy and can be constituted of inexpensive components. It therefore does not add substantially to the cost of the solenoid valve drive apparatus. This timer circuit need not be constituted as a C-R time constant circuit as shown in FIG. 3, but, as shown in FIG. 8, can instead be constituted as a logic circuit comprising an AND circuit 78 provided on its input side with a timer 79.

Moreover, since operation of the solenoid valve drive apparatus 1 is unaffected by any variance in the characteristics of the solenoid valves arising during their manufacture, it ensures smooth transition from initial driving by the high voltage VP to constant-current driving by supply of hold current, thereby enabling very stable and reliable driving of the solenoid valves. The stability of the operation is further enhanced by the fact that it is not greatly affected by changes in the ambient temperature or other operating environment factors.

Figure 9:
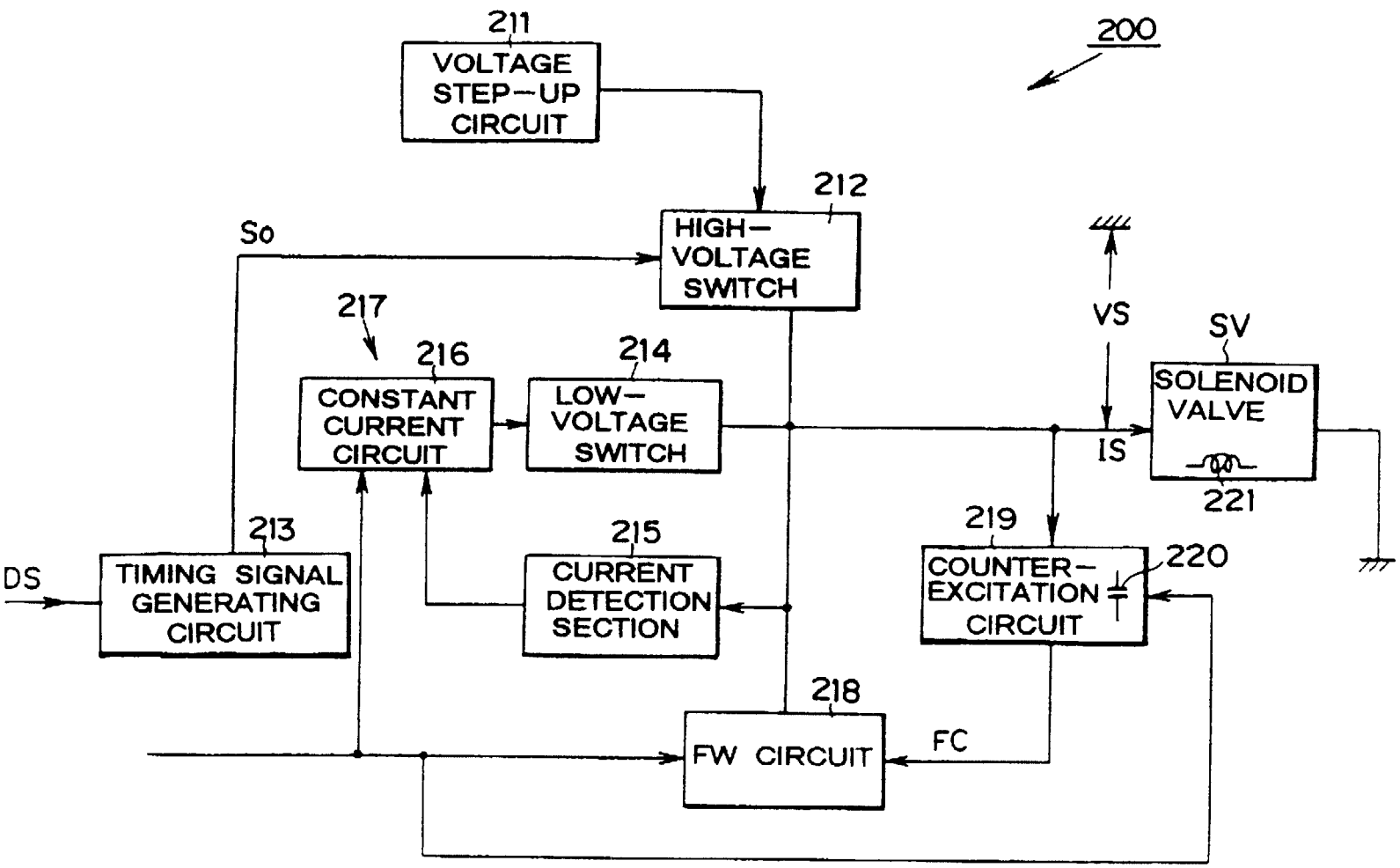
FIG. 9 is a block diagram showing a solenoid valve drive apparatus which is another embodiment of the invention.

FIG. 9 is a block diagram showing a solenoid valve drive apparatus 200 which is another embodiment of the invention. The solenoid valve drive apparatus 200 shown in FIG. 9 is responsive to a solenoid valve drive signal DS applied from the outside for controlling the opening and closing of a solenoid valve SV. In FIG. 9, reference numeral 211 designates a voltage step-up circuit for stepping up DC voltage from a DC power supply (not shown) and 212 designates a high-voltage switch for supplying high voltage supplied from the voltage step-up circuit 211 to the solenoid coil 221 of the solenoid valve SV. Reference numeral 213 designates a timing signal generating circuit 213 responsive to the solenoid valve drive signal DS for outputting a timing signal So indicative of the time period the high-voltage switch 212 is to be kept closed. The high-voltage switch 212 is kept closed while the level of the timing signal So is high for applying the high voltage from the voltage step-up circuit 211 through the high-voltage switch 212 to the solenoid coil 221 of the solenoid valve SV.

Reference numeral 214 designates a low-voltage switch for applying a DC voltage from a DC power supply (not shown) to the solenoid coil 221 of the solenoid valve SV so as to pass required constant current through the solenoid coil 221. A current detection section 215 is provided for detecting the level of the solenoid current IS flowing through the solenoid coil 221 and a constant current circuit 216 is provided for on/off controlling the low-voltage switch 214 for driving the solenoid valve SV at a certain constant current in response to the solenoid valve drive signal DS and taking into account the detection output from the current detection section 215. The low-voltage switch 214, the current detection section 215 and the constant current circuit 216 together constitute a current control section 217. The current control section 217 also functions to reduce the current passed through the solenoid coil 221 after the solenoid coil 221 has been driven by the high voltage from the solenoid coil 221. This will be explained further later.

Reference numeral 218 designates a flywheel (FW) circuit which is responsive to the solenoid valve drive signal DS for supplying flywheel current to the solenoid valve SV when the low-voltage switch 214 is off during the drive period defined by the solenoid valve drive signal DS. Reference numeral 219 is a counter-excitation circuit including a capacitor 220 charged by energy self-induced in the solenoid coil 221 upon cut-off of drive current to the solenoid valve SV. At the termination of solenoid valve SV driving, the counter-excitation circuit 219 applies the voltage charged in the capacitor 220 to the solenoid coil 221 of the solenoid valve SV so as to counter-excite the solenoid coil 221. An FW control signal FC based on the terminal voltage of the capacitor 220 of the counter-excitation circuit 219 is applied from the counter-excitation circuit 219 to the FW circuit 218 as a control signal for enabling/disabling the flywheel current supply operation of the FW circuit 218.

Figure 10:
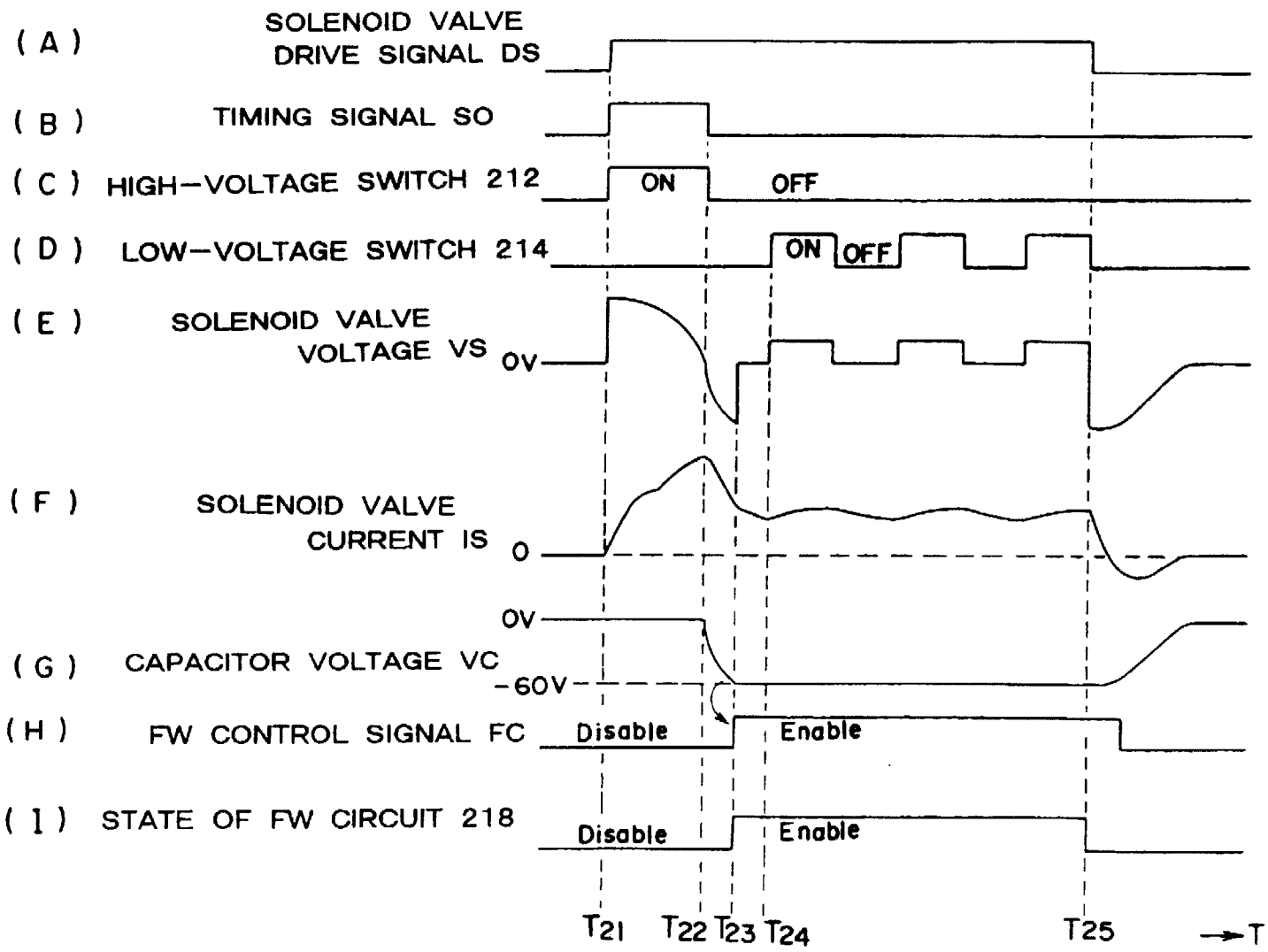
FIG. 10 is a diagram showing waveforms of signals at different portions of the solenoid valve drive apparatus shown in FIG. 9 for explaining the operation thereof.

The operation of the solenoid valve drive apparatus 200 shown in FIG. 9 will now be explained with reference to FIG. 10. The horizontal axis in FIG. 10 represents lapsed time T. The operation of the solenoid valve SV starts at T=T21 when the solenoid valve drive signal DS changes from low level to high level (FIG. 10 (A)). The timing signal So (FIG. 10 (B)) is output from the timing signal generating circuit 213 and applied to the high-voltage switch 212 in response to the rise of the solenoid valve drive signal DS (T=T21). The timing signal generating circuit 213 can be constituted, for example, as a monostable multivibrator circuit.

The timing signal So is for determining the period of application of the high voltage from the voltage step-up circuit 211 to the solenoid valve SV during initial driving of the solenoid valve SV. The high-voltage switch 212 stays closed (ON) (FIG. 10 (C)) while the timing signal So is at high level to apply the high voltage from the voltage step-up circuit 211 to the solenoid valve SV. As shown at FIG. 10 (E), the solenoid valve voltage VS applied to the solenoid coil 221 is high immediately after the high-voltage switch 212 closes and then gradually decreases with the passage of time. This is because the charge voltage of a capacitor (not shown) included in the voltage step-up circuit 211 is used as the solenoid valve voltage VS. As shown at FIG. 10 (F) the solenoid current IS rises with passage of time from T=T21 and peaks at T=T22 when the high-voltage switch 212 turns off. Since a large solenoid current IS thus passes from the voltage step-up circuit 211 through the solenoid coil 221 during the period T21<T<T22, the solenoid valve SV operates at high speed during the initial driving stage.

Since a large back electromotive force is produced in the solenoid coil 221 of the solenoid valve SV when the high-voltage switch 212 opens (turns off) at T=T22, the solenoid valve voltage VS becomes large in the negative direction. Since the capacitor 220 of the counter-excitation circuit 219 is charged by the negative voltage produced by this back electromotive force, its terminal voltage falls rapidly (becomes large in the negative direction), reaching a prescribed value, e.g., about −60 V, at T=T23. During the period T22<T<T23, the solenoid current IS gradually decreases.

The FW control signal FC is at low level (disabled state) when the absolute value of the capacitor voltage VC, i.e., the charge voltage of the capacitor 220, is at or below the prescribe value of 60 V and is at high level (enabled state) when the absolute value of the capacitor voltage VC is higher than the prescribed value of 60 V (see FIG. 10 (G), (H)).

In this embodiment, the high-voltage driving is terminated at T=T22 and the FW control signal FC becomes high level (enable state) at T=T23 to enable the FW circuit 218 to operate for passing flywheel current through the solenoid coil 221 of the solenoid valve SV. This marks the start of constant current driving. When the solenoid current IS decreases to below a prescribed level at T=T24, this decrease is detected by the current detection section 215 and the low-voltage switch 214 is turned on (FIG. 10 (D)) by the constant current circuit 216. The solenoid valve voltage VS therefore becomes the same as the output voltage of the DC power supply (not shown), whereby the solenoid current IS again increases. When the solenoid current IS rises above a prescribed value, the low-voltage switch 214 again turns off. The solenoid coil 221 is thus supplied with approximately constant driving current. The on/off control of the low-voltage switch 214 for the aforesaid constant current driving by the current control section 217 continues until the solenoid valve drive signal DS becomes low level at T=T25.

The FW circuit 218 is configured so that the flywheel current can be passed through the solenoid coil 221 of the solenoid valve SV only while both the FC control signal FC and the solenoid valve drive signal DS are at high level (FIG. 10 (A), (H), (I)). During the period T23<T<T25, when the FW circuit 218 supplies current from ground toward the high side of the solenoid valve SV during the period that the low-voltage switch 214 is off, the terminal voltage of the solenoid valve SV becomes approximately ground level so that the capacitor 220 in the counter-excitation circuit 219 is not charged.

When the solenoid valve drive signal DS falls to low level at T=T25, supply of flywheel current by the FW circuit 218 is stopped simultaneously with the termination of constant current drive control by the current control section 217. The counter-excitation circuit 219 operates in response to the fall of the solenoid valve drive signal DS to low level at T=T25, thereby enabling application of the high negative voltage energy stored in the capacitor 220 to the solenoid coil 221 of the solenoid valve SV. Counter-excitation current is therefore passed through the solenoid coil 221 as magnetic flux extinguishing current.

As is clear from the foregoing explanation, since the charging of the capacitor 220 by the back electromotive force produced in the solenoid coil 221 of the solenoid valve SV owing to the switching of the high-voltage switch 212 from on to off is controlled in the foregoing manner, the charge voltage of the capacitor 220 is kept at a prescribed constant value irrespective of fluctuations in the temperature coefficients of the different components and/or in the power supply voltage. The counter-excitation of the solenoid coil 221 can therefore always be conducted at a prescribed constant voltage. Since the counter-excitation driving for shortening the recovery time of the solenoid valve SV can therefore be effected with the same energy every time, variance in the solenoid valve SV recovery time can be markedly reduced to enable highly accurate control of solenoid valve opening and closing. Other advantages of the configuration shown in FIG. 9 include:

(a) The circuitry is simple and low in cost because charging of the capacitor for storing counter-excitation energy need not be time controlled.

(b) Component breakdown can be prevent because the capacitor for storing counter-excitation energy is never overcharged.

(c) A compact solenoid valve drive apparatus can be manufactured at low cost using inexpensive components since overcharging of the capacitor for storing counter-excitation energy is prevented.

Figure 11:
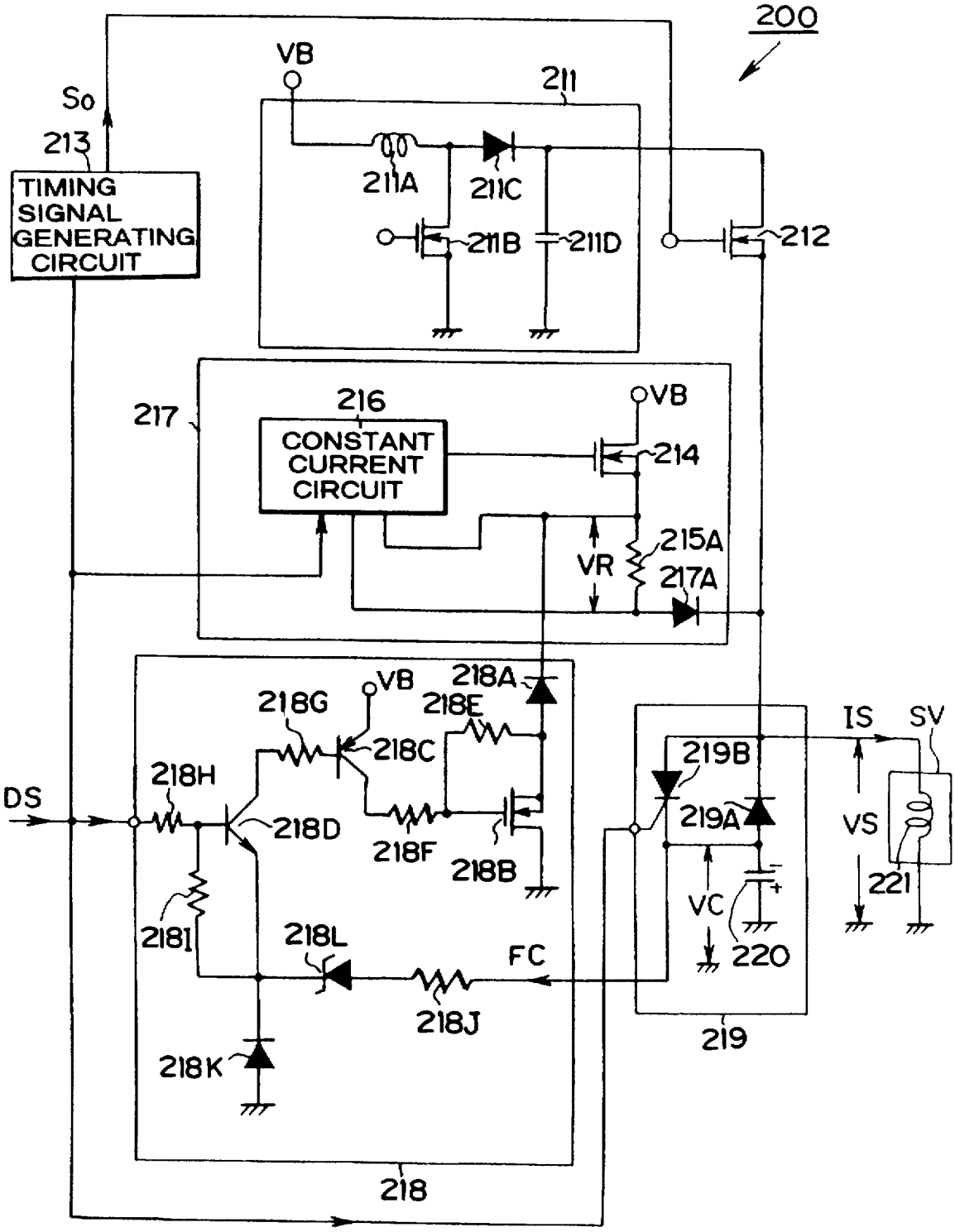
FIG. 11 is a circuit diagram showing a specific configuration of the solenoid valve drive apparatus shown in FIG. 9.

FIG. 11 is a circuit diagram showing a specific configuration of the solenoid valve drive apparatus 200 shown in FIG. 9. The portions in FIG. 11 which correspond to portions shown FIG. 9 are assigned the same reference symbols as those in FIG. 9 and will not be explained further here. The voltage step-up circuit 211 comprises a transistor 211B which on/off controls application of a power supply voltage VB to a coil 211A to produce a high voltage that is forwarded through a diode 211C to be stored in a capacitor 211D. This is a well-known configuration. The high voltage produced across the terminals of the capacitor 211D is applied to the solenoid coil 221 of the solenoid valve SV through the high-voltage switch 212, which is constituted as a switching transistor on/off controlled by the timing signal So.

The current control section 217 comprises the low-voltage switch 214, constituted as a switching transistor, and a current detection resistor 215A connected in series therewith. The power supply voltage VB is applied through this series connection and a diode 217A for preventing reverse current flow to the high side of the solenoid coil 221, whose other terminal is connected to ground. The current flowing through the solenoid coil 221 owing to the application of the power supply voltage VB therefore also simultaneously passes through the current detection resistor 215A. The detection voltage VR produced across the current detection resistor 215A as a result is input to the constant current circuit 216 as a detection signal indicative of the level of the solenoid current IS. During the constant current drive control period falling within the period that the solenoid valve drive signal DS is at high level, the constant current circuit 216 is responsive to the detection voltage VR to on/off control low-voltage switch 214 in order to pass constant current through the solenoid valve SV.

The counter-excitation circuit 219 comprises a diode 219A and a thyristor 219B in addition to the capacitor 220. These components are connected as shown in FIG. 11. The back electromotive force produced in the solenoid coil 221 of the solenoid valve SV when the high-voltage switch 212 switches from on to off therefore charges the capacitor 220 through the diode 219A in the polarity shown in the drawing. The stored charge is retained without flowing to the solenoid coil 221 owing to the presence of the diode 219A. When the solenoid valve drive signal DS changes from high level to low level, the thyristor 219B is triggered and becomes conductive so that the charge stored in the capacitor 220 passes through the thyristor 219B and the solenoid coil 221 of the solenoid valve SV, whereby current for counter-excitation flows through the solenoid coil 221.

The FW circuit 218 comprises a flywheel diode 218A and a switching transistor 218B which enables/disables passage of flywheel current from the FW circuit 218 to the solenoid coil 221 of the solenoid valve SV. Reference numerals 218C and 218D designate switching transistors, 218E–218J resistors, 218K a diode, and 218L a Zener diode. In this embodiment, the solenoid valve drive signal DS is applied to the base of the switching transistor 218D through the resistor 218H, and the capacitor voltage VC is applied as the flywheel control signal FC through the resistor 218J and the Zener diode 218L to the emitter of the switching transistor 218D, which emitter is connected to ground through the diode 218K.

With this configuration, the Zener diode 218L does not become conductive and, accordingly, the switching transistor 218D does not become conductive unless the capacitor voltage VC, i.e., the terminal voltage of the capacitor 220, becomes small (large in the negative direction). In other words, when the capacitor voltage VC is equal to or greater than a prescribed value of, say, −60 V, determined by the Zener voltage of the Zener diode 218, the switching transistor 218D remains off even when the solenoid valve drive signal DS is at high level so that the flywheel diode 218B cannot be put in conductive state to operate the FW circuit 218. On the other hand, when the capacitor voltage VC is less than the prescribed level (e.g., −60 V), the switching transistors 218D, 218C turn on in response to rise of the solenoid valve drive signal DS to high level, the switching transistor 218B becomes conductive, and flywheel current from the flywheel diode 218A flows through the solenoid valve SV.

Since the operation of the solenoid valve drive apparatus 200 according to FIG. 11 is the same as that explained earlier with reference to FIG. 10 regarding the solenoid valve drive apparatus 200 shown in FIG. 9, this explanation will not be repeated here.

The embodiment shown in FIGS. 9 and 11 explained in the foregoing relates to a configuration provided with the voltage step-up circuit 211 and the high-voltage switch 212 for applying high voltage to the solenoid valve SV at the initial stage of driving the solenoid valve SV, wherein back electromotive force produced in the solenoid valve SV upon termination of high-voltage application by these members is used to charge the capacitor 220 of the counter-excitation circuit 219.

Figure 12:
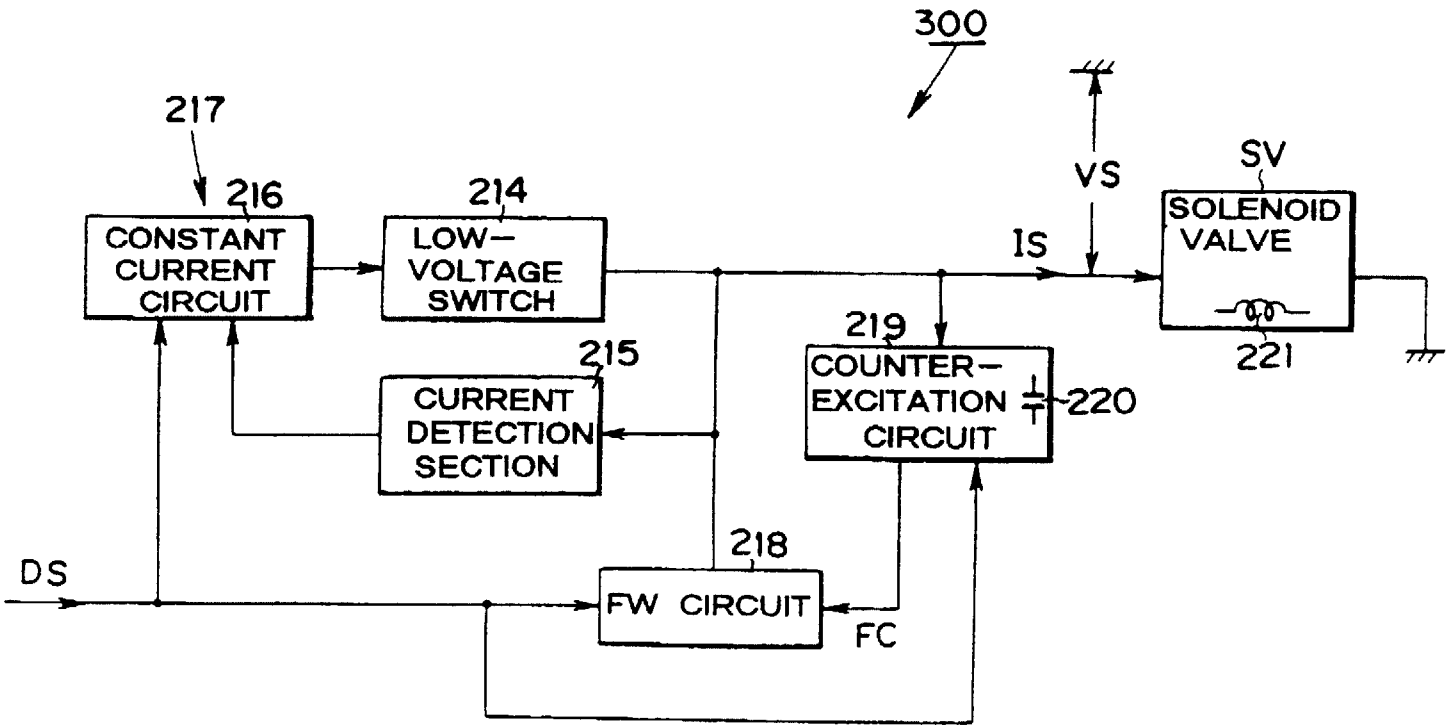
FIG. 12 is a block diagram showing another solenoid valve drive apparatus which is another embodiment of the invention.

FIG. 12 is a block diagram showing a solenoid valve drive apparatus which is another embodiment of the invention.

wherein constant current driving of the solenoid valve SV is effected without applying a high voltage during the initial driving stage and counter-excitation is effected at the termination of the constant current driving. The solenoid valve drive apparatus 300 shown in FIG. 12 is configured by eliminating the voltage step-up circuit 211, the high-voltage switch 212 and the timing signal generating circuit 213 from the solenoid valve drive apparatus 200 shown in FIG. 9. The portions in FIG. 12 which correspond to portions shown FIG. 9 are assigned the same reference symbols as those in FIG. 9 and will not be explained further here.

In the configurations of FIGS. 9 and 11, the back electromotive force produced in the solenoid coil 221 of the solenoid valve SV when the high-voltage switch 212 switches from on to off charges the capacitor 220 to a prescribed voltage at one time. The configuration shown in FIG. 12 differs from this in that it uses the back electromotive force produced in the solenoid coil 221 of the solenoid valve voltage SV every time the low-voltage switch 214 turns from on to off for constant current driving for repeatedly charging the capacitor 220 little by little until the prescribed voltage value is reached.

Figure 13:
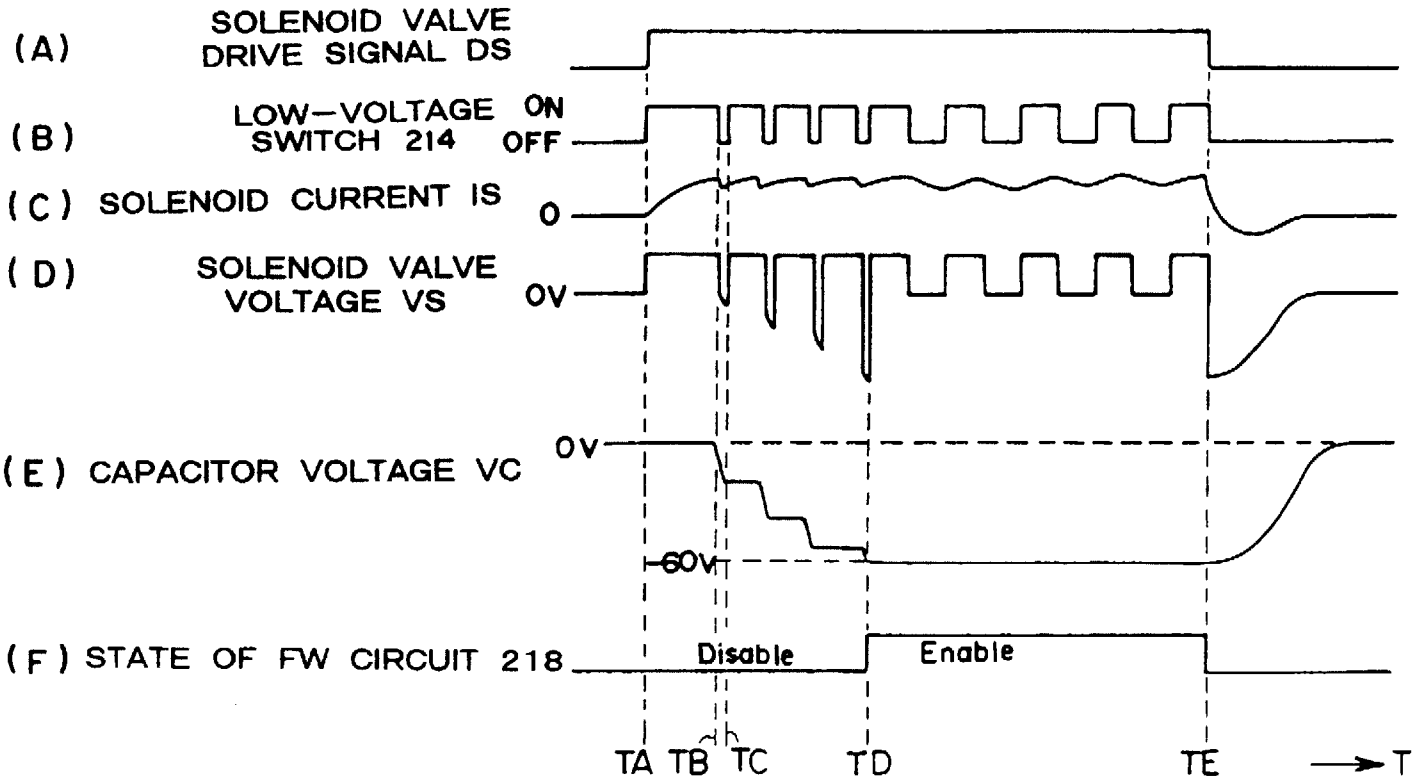
FIG. 13 is a diagram showing waveforms of signals at different portions of the solenoid valve drive apparatus shown in FIG. 12 for explaining the operation thereof.

This will be explained with reference to FIG. 13. The horizontal axis in FIG. 13 represents lapsed time T. When the level of the solenoid valve drive signal DS changes from low to high at T=TA (FIG. 13 (A), the current control section 217 starts constant current driving of the solenoid valve SV and the low-voltage switch 214 turns on (FIG. 13 (B)). As a result, the power supply voltage is applied to the solenoid coil 221 of the solenoid valve SV (FIG. 13 (D) and the solenoid current IS rises gradually (FIG. 13 (C)). At T=TB, when the current detection section 215 detects that the solenoid current IS has reached the prescribed level for constant current driving, the constant current circuit 216 turns off the low-voltage switch 214.

Since the back electromotive force produced in the solenoid coil 221 of the solenoid valve SV at this time charges the capacitor 220, the capacitor voltage VC across the terminals of the capacitor 220 increases greatly in the negative direction (FIG. 13 (E). Since voltage is not being applied because the low-voltage switch 214 is off and since the capacitor voltage VC has not yet reached the prescribed level, the FW circuit 218 is in an operation disabled state (FIG. 13 (F)). The level of the solenoid current IS therefore decreases with a relatively short period. The low-voltage switch 214 turns on in response to this decrease at T=TC, whereby the solenoid valve voltage VS again rises to the power supply voltage.

The constant current drive control is effected by repeated turning on and off of the low-voltage switch 214 in this manner. When the capacitor voltage VC of the capacitor 220 reaches a prescribed level (−60 V in this embodiment) at T=TD, operation of the FW circuit 218 is enabled, whereafter the constant current drive control with flow of flywheel current continues until the solenoid valve drive signal DS falls to low level at T=TE. The level of the solenoid valve drive signal DS changes from high to low at T=TE. This terminates the constant current drive control. At the same time, the counter-excitation circuit 219 operates to pass counter-excitation current through the solenoid coil 221 of the solenoid valve SV, thereby hastening the recovery of solenoid valve SV operation. This is the same as in the case of the solenoid valve drive apparatus 200 of FIG. 9.

In any of the embodiments of FIGS. 9, 11 and 12, the current detection section 215 and the constant current circuit 216 of the current control section 217 can be replaced with a pulse generator which produces pulses of desired frequency and duty ratio. This simplifies the configuration. When charging of the capacitor 220 is insufficient, a configuration combining the configurations of FIGS. 9, 11 and 12 can be used.

Figure 14:
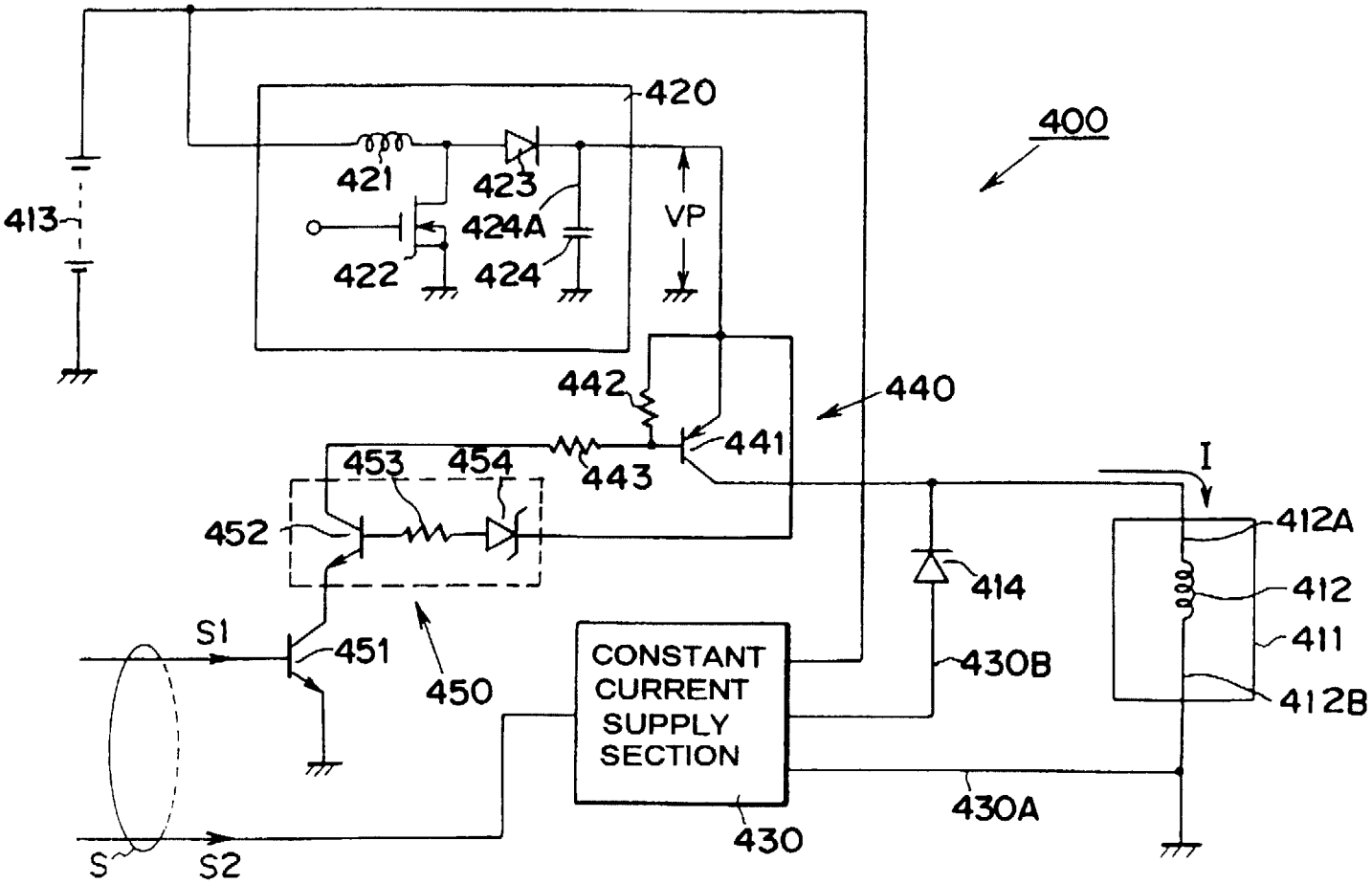
FIG. 14 is a circuit diagram showing another embodiment of the invention.

FIG. 14 is a circuit diagram showing another solenoid valve drive apparatus which is another embodiment of the invention. The embodiment shown in FIG. 14 is an application of the invention to a solenoid actuator drive apparatus 400 configured to drive the solenoid actuator (electromagnetic load) for driving a fuel injection valve for supplying a vehicle engine with fuel by injection.

The solenoid actuator drive apparatus 400 is for driving the solenoid actuator 411 of a fuel injection valve (not shown) for supplying fuel to an engine by injection. The solenoid actuator drive apparatus 400 is responsive to a pair of drive control signals S supplied from a control unit (not shown) for supplying excitation current I to a solenoid coil 412 of the solenoid actuator 411 connected to the output side of the solenoid actuator drive apparatus 400 as an electromagnetic load. The excitation current I is supplied from a high-voltage supply section 420 and a constant current supply section 430 as explained in the following.

The high-voltage supply section 420 is equipped with a coil 421 and a switching transistor 422 constituting a step-up circuit for stepping up a voltage from an on-board battery 413 to a high voltage of one hundred and several tens of volts. The high-voltage output obtained from the step-up circuit is forwarded through a diode 423 and stored in a capacitor 424 as high-voltage energy for operating the solenoid actuator 411 at high speed. The high voltage VP stored in the capacitor 424 is therefore supplied from the high-voltage supply section 420 to the solenoid coil 412 as high-voltage energy for high-speed operation of the solenoid actuator 411.

One end 424A of the capacitor 424 is connected to one end 412A of the solenoid coil 412 of the solenoid actuator 411 through a switching circuit 440. The other end 412B of the solenoid coil 412 is connected to ground, whereby it is electrically connected to the negative terminal of the battery 413. The switching circuit 440 comprises a switching transistor 441 and resistors 442, 443 connected as shown in the drawing. The conductive state between the emitter and collector of the switching transistor 441 is controlled by current flowing to the base thereof through the resistor 443. The flow of high-voltage energy from the capacitor 424 to the solenoid actuator 411 is controlled by this conductive state.

The constant current supply section 430 is supplied with power by the battery 413 and supplies the solenoid coil 412 with constant current required for holding the steady operating state of the solenoid actuator 411. The negative output line 430A of the constant current supply section 430 is connected to ground, and the positive output line 430B thereof is connected to the one end 412A of the solenoid coil 412 and includes a diode 414 connected in the polarity shown in the drawing. Prescribed constant current is therefore supplied from the constant current supply section 430 to the solenoid actuator 411 only when the voltage on the positive output line 430B becomes larger than the high voltage VP so as to forward bias the diode 414. As explained further below, the supply of the constant current from the constant current supply section 430 is controlled in response to a second control signal S2 (one of the pair of drive control signals S).

Reference numeral 450 designates a control circuit operative in response to the high voltage VP and a first control signal S1 (one of the pair of drive control signals S, which sets the maximum discharge time of the capacitor 424 of the high-voltage supply section 420) for controlling the switching circuit 440 so as to supply high-voltage energy from the capacitor 424 to the solenoid coil 412 only during the initial driving stage of the solenoid actuator 411.

The control circuit 450 comprises switching transistors 451, 452, a resistor 453 and a Zener diode 454 connected as shown in the drawing. The first control signal S1 is applied to the base of the switching transistor 451 for controlling the on/off operation thereof. The high voltage VP is applied to the base of the switching transistor 452 through the Zener diode 454 and the resistor 453. The resistor 443 connected to the base of the switching transistor 441 is connected to ground through the collector-emitter circuits of the switching transistors 451, 452.

Therefore, when the first control signal S1 is at low level, the switching transistor 451 is off and the emitter voltage of the switching transistor 452 is indefinite. Since the switching transistors 451, 452 are therefore off, the switching transistor 441 does not become conductive even when the level of the high voltage VP is high enough to make the Zener diode 454 conductive in the reverse direction. The capacitor 424 therefore retains its high-voltage energy charge. When the level of the first control signal S1 then changes from low to high, the switching transistor 451 turns on. Since the emitter voltage of the switching transistor 452 becomes definite, the switching transistor 452 turns on. The switching transistor 441 therefore turns on and the high voltage VP stored in the capacitor 424 is applied to the solenoid coil 412 through the switching transistor 441.

Figure 15:
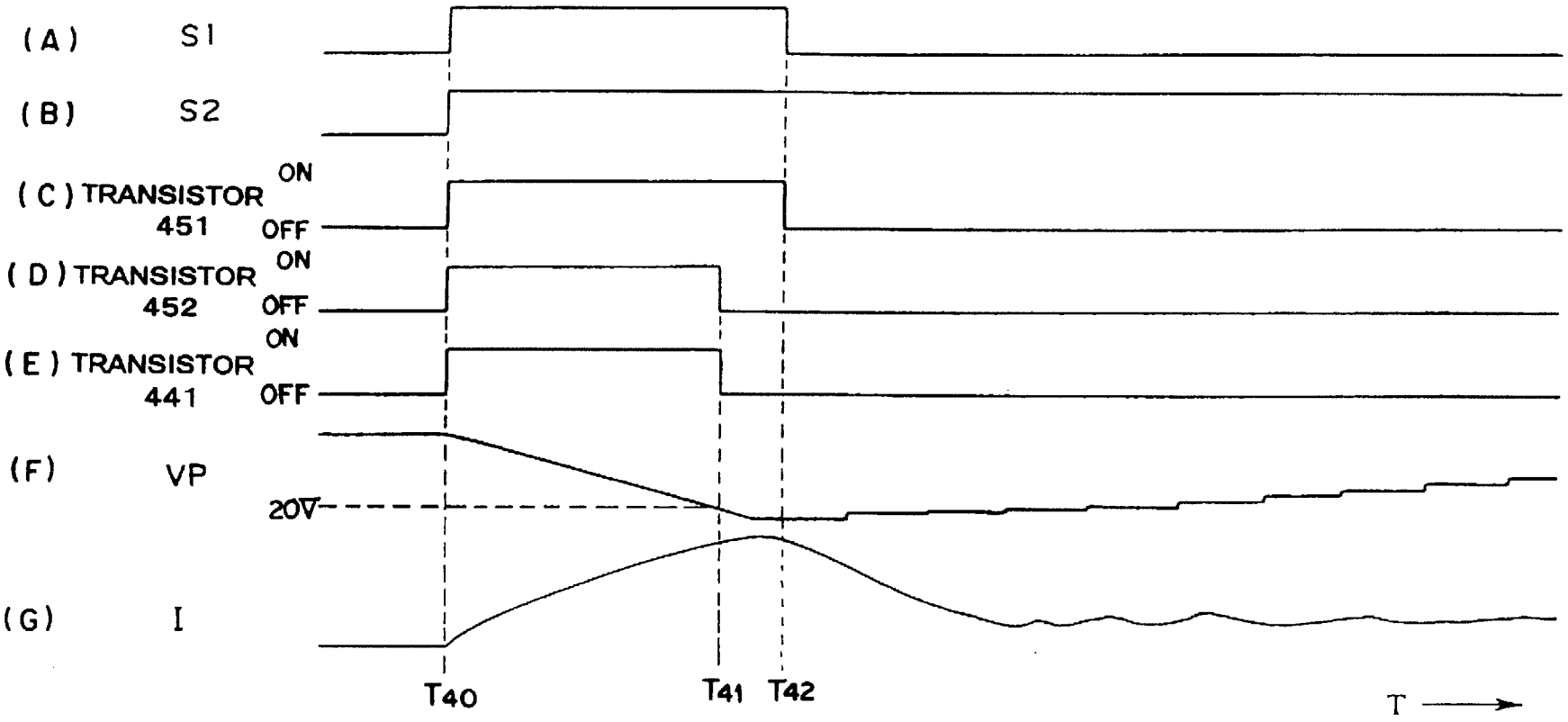
FIG. 15 is a diagram showing waveforms of signals at different portions of the solenoid actuator drive apparatus shown in FIG. 14 for explaining the operation thereof.

The operation of the solenoid actuator drive apparatus 400 will now be explained with reference to FIG. 15. The horizontal axis in FIG. 15 represents time. The change with lapsed time T in the level of the first control signal SI is shown by (A), that in the level of the second control signal S2 by (B), that in the on/off state of the switching transistor 451 by (C), that in the on/off state of the switching transistor 452 by (D), that in the on/off state of the switching transistor 441 by (E), that in the level of the high voltage VP by (F), and that in the level of excitation current I by (G).

The levels of the first control signal S1 and the second control signal S2 rise from low to high at T=T40. The switching transistors 451, 452, 441 therefore switch from off to on substantially simultaneously, whereby the high voltage VP stored in the capacitor 424 is applied to the solenoid coil 412 through the switching transistor 441 of the switching circuit 440. Although the constant current supply section 430 is also made operative simultaneously, no current flows from the constant current supply section 430 to the solenoid coil 412 because the level of the high voltage VP is sufficiently high to keep the diode 414 in reverse biased state.

The charge stored in the capacitor 424 is rapidly discharged with passage of time from T40 and the level of the high voltage VP falls accordingly. By T=T41, the high voltage VP falls to about the same level as the Zener voltage ZD of the Zener diode 454 (set at ZD=20 V in this embodiment). Since the Zener diode 454 is therefore reversed biased, supply of base current to the switching transistor 452 is cut off and the switching transistor 452 turns off.

Since the first control signal S1 is still at high level at this time, the switching transistor 451 is maintained in conductive state. At T=T42, the switching transistor 451 also turns off, however, in response to the fall of the first control signal S1 to low level. FIG. 15 shows that VP decreases even though switching transistor 441 has turned off. This is because of device operation delay. The diode 414 is thereafter maintained in forward biased state so that the constant current supply section 430 supplies constant current as operation hold current for holding the steady operating state of the solenoid coil 412 until the second control signal S2 falls to low level.

The level of the excitation current I supplied to the solenoid actuator 411 therefore rises rapidly from T=T40 to enable high-speed operation of the solenoid actuator 411 at the initial driving stage. The excitation current I peaks at T=T42, when the high voltage VP falls to zero after first dropping to the prescribed level defined by the Zener voltage ZD of the Zener diode 454. The constant current supply section 430 thereafter supplies constant current to the solenoid coil 412 as excitation current.

As explained in the foregoing, the solenoid actuator drive apparatus 400 is constituted to first apply the high voltage VP to the solenoid coil 412 and then switch to constant current driving mode when the high voltage VP from the capacitor 424 has fallen to a prescribed level. It is therefore of simple configuration and, moreover, in accordance with the level of the high voltage VP, enables optimum peak current produced by high voltage to be imparted for rapid operation in the initial driving stage. As can be seen from FIG. 15, therefore, if time T42 corresponding to the trailing edge of the first control signal S1 is set somewhat late, a circuit capable of coping with variance in the reactance component and resistance component of the solenoid coil 412 can be easily designed. In addition, since no current detection resistor is provided in series with the solenoid coil 412, energy loss is small, and since strict time control is not required, use of expensive, high-precision components is not necessary, thus reducing cost. As the length of the peak current period is kept to the minimum necessary, moreover, voltage step-up for the next cycle can be started promptly, enabling shortening of the driving period and providing other advantages.

What is claimed is:

1. A method for driving an electromagnetic load by, in response to a given control pulse signal, applying high voltage to the electromagnetic load at an initial driving stage to quickly operate the electromagnetic load, thereafter shifting to a constant current driving state, and applying counter-excitation to the electromagnetic load upon terminating driving thereof, the method comprising in response to the control pulse signal, applying high voltage to the electromagnetic load for a prescribed time period starting from a leading edge time point of the control pulse signal, in response to a back electromotive force produced in the electromagnetic load upon cut-off of the application of the high voltage to the electromagnetic load, supplying the electromagnetic load with a constant current required for holding operation of the electromagnetic load until a trailing edge time point of the control pulse signal, using the back electromotive force produced in the electromagnetic load to store electrical energy in energy storage means, and in response to the control pulse signal, starting to supply electrical energy stored in the energy storage means to the electromagnetic load as counter-excitation current at the trailing edge time point of the control pulse signal.

2. An apparatus for driving an electromagnetic load which is provided on a high side of the electromagnetic load, one terminal of which is connected to ground, and is responsive to a given control pulse signal for quickly operating the electromagnetic load by high voltage application in an initial driving stage, thereafter shifting to a constant current driving state, and effecting counter-excitation upon termination of driving, the apparatus comprising a high-voltage supply section for producing high voltage for application to the electromagnetic load, a high-voltage application control circuit responsive to the control pulse signal for controlling the high-voltage supply section to cause it to apply high voltage to the electromagnetic load for a prescribed time period starting from a leading edge time point of the control pulse signal, a hold current supply section responsive to a back electromotive force produced in the electromagnetic load upon cut-off of the high voltage applied to the electromagnetic load by the high-voltage supply section for starting supply of operation hold current to the electromagnetic load and continuing the supply thereof until a trailing edge time point of the control pulse signal, thereby effecting constant current driving of the electromagnetic load, an energy storage circuit for storing electrical energy using the back electromotive force produced in the electromagnetic load, and a counter-excitation current supply control circuit responsive to the control pulse signal for starting supply of electrical energy stored in the energy storage circuit to the electromagnetic load as counter-excitation current at the trailing edge time point of the control pulse signal.

3. An apparatus as claimed in claim 2, wherein the high-voltage supply section comprises a step-up circuit for producing a high voltage and switching circuit means for controlling application of the high voltage produced by the step-up circuit to the electromagnetic load.

4. An apparatus as claimed in claim 3, wherein the switching circuit means includes a semiconductor switching device whose conductive state is controlled in response to a control output from the high-voltage application control circuit and the high voltage is applied to the electromagnetic load when the semiconductor switching device is made conductive.

5. An apparatus as claimed in claim 4, wherein the switching circuit means further comprises conductivity control circuit means responsive to the high voltage and the control output for controlling the conductive state of the semiconductor switching device in accordance with the control output only when the high voltage is equal to or greater than a prescribed voltage.

6. An apparatus as claimed in claim 4, wherein the control output from the high-voltage application control circuit is a signal for putting the semiconductor switching device in conductive state only for a prescribed time period starting from the leading edge time point of the control pulse signal.

7. An apparatus as claimed in claim 5, wherein the control output from the high-voltage application control circuit is a signal for putting the semiconductor switching device in conductive state only for a prescribed time period starting from the leading edge time point of the control pulse signal.

8. An apparatus as claimed in claim 2, wherein the high-voltage application control circuit comprises an integration circuit for integrating the control pulse signal, a first switching transistor device whose conductivity state is maintained at one conductivity state for a prescribed period starting from the leading edge time point of the control pulse signal in response to an output of the integration circuit, and a second switching transistor device having an input circuit to which the control pulse signal is input and with which the first switching transistor device is connected, whereby the second switching transistor device outputs a control signal for controlling the high-voltage supply section in response to the control pulse signal and the conductivity state of the first switching transistor device.

9. An apparatus as claimed in claim 2, wherein the energy storage circuit comprises a capacitor charged by the back electromotive force produced in the electromagnetic load.

10. An apparatus as claimed in claim 9, wherein the energy storage circuit further comprises a diode between the capacitor and the electromagnetic load for establishing a path for charging by the back electromotive force produced in the electromagnetic load.

11. An apparatus as claimed in claim 9, wherein the hold current supply section comprises a flywheel circuit for supplying flywheel current to the electromagnetic load when the charge voltage of the capacitor becomes smaller than a prescribed negative value during an electromagnetic load driving period defined by the control pulse signal and a constant current control section for detecting the value of current supplied to the electromagnetic load and when the detected current value is equal to or less than a prescribed basic value supplying driving current to the electromagnetic load to supply the electromagnetic load with required substantially constant current.

12. An apparatus as claimed in claim 11, wherein the flywheel circuit comprises a flywheel diode for forming a current path for passing flywheel current to the electromagnetic load, on/off switching means connected in series with the flywheel diode for turning the flywheel current on and off, and on/off control means responsive to the control pulse signal and the charge voltage of the capacitor for controlling the on/off switching means to turn off the flywheel current when the charge voltage of the capacitor becomes smaller than a prescribed negative value during an electromagnetic load driving period defined by the control pulse signal.

13. An apparatus as claimed in claim 11, wherein the constant current control section comprises current detection means for detecting the value of current passed to the electromagnetic load and means responsive to a detection output of the current detection means for applying DC voltage to the electromagnetic load to pass drive current therethrough when the detected current value is equal to or less than the prescribed basic current value.

14. An apparatus as claimed in claim 13, wherein the current detection means is a resistor connected in series with the electromagnetic load.

15. An apparatus as claimed in claim 2, wherein the counter-excitation current supply control circuit comprises a thyristor device connected between the energy storage circuit and the electromagnetic load and a trigger signal generation means for generating a trigger pulse signal at the trailing edge time point of the control pulse signal, the thyristor device being switched to conductive state by the trigger pulse signal to supply electrical energy stored in the energy storage circuit to the electromagnetic load to counter-excite the electromagnetic load.

16. A method for driving an electromagnetic load by applying high voltage to the electromagnetic load for a prescribed time period to drive it at an initial driving stage thereof, thereafter reducing current passing through the electromagnetic load, supplying flywheel current to the electromagnetic load from a flywheel circuit from the time of cut-off of current supply to the electromagnetic load at the end of the prescribed time period to the time of terminating electromagnetic load driving, charging a capacitor using self-induced energy produced in the electromagnetic load by the cut-off of current supply to the electromagnetic load, and applying charge voltage of the capacitor to the electromagnetic load for counter-exciting the electromagnetic load upon terminating driving thereof, the method comprising effecting control based on the absolute value of the charge voltage of the capacitor after the driving of the electromagnetic load by application of high voltage terminates to stop the supply of flywheel current to the electromagnetic load by the flywheel circuit and charge the capacitor by the self-induced energy produced in the electromagnetic load when the absolute value of the charge voltage of the capacitor becomes equal to or less than a prescribed value and to conduct supply of flywheel current to the electromagnetic load by the flywheel circuit and disable charging of the capacitor when the absolute value of the charge voltage of the capacitor becomes greater than the prescribed value.

17. An apparatus for driving an electromagnetic load comprising a current control section for on/off controlling current flowing through the electromagnetic load to drive the electromagnetic load with a required constant current, a flywheel circuit for supplying flywheel current to the electromagnetic load when supply of current to the electromagnetic load is turned off by the current control section, and a counter-excitation circuit which includes a capacitor charged by self-induced energy produced in the electromagnetic load by cut-off of driving current to the electromagnetic load and applies the charge voltage of the capacitor to the electromagnetic load for counter-excitation of the electromagnetic load upon terminating driving of the electromagnetic load, the supply of flywheel current to the electromagnetic load by the flywheel circuit being stopped and the capacitor being charged when the absolute value of the charge voltage of the capacitor becomes equal to or less than a prescribed value and supply of flywheel current to the electromagnetic load by the flywheel circuit being conducted and charging of the capacitor being disabled when the absolute value of the charge voltage of the capacitor becomes greater than the prescribed value.

18. An apparatus as claimed in claim 17, wherein the flywheel circuit comprises a flywheel diode for forming a current path for passing flywheel current to the electromagnetic load, on/off switching means connected in series with the flywheel diode for turning the flywheel current on and off, and on/off control means responsive to the charge voltage of the capacitor for controlling the on/off switching means to turn off the flywheel current when the absolute value of the charge voltage of the capacitor becomes smaller than a prescribed value during an electromagnetic load driving period.

19. An apparatus for driving an electromagnetic load which applies a high voltage to the electromagnetic load at an initial driving stage to operate the electromagnetic load at high speed and thereafter applies a hold current of required constant level to the electromagnetic load to hold it in a steady operating state, the apparatus comprising a high-voltage supply section including a capacitor for storing high-voltage energy for the high-speed operation of the electromagnetic load, switching means provided between the capacitor and the electromagnetic load for supplying high-voltage energy from the capacitor to the electromagnetic load, and control circuit means responsive to an electric signal for starting electromagnetic load driving and the output voltage of the capacitor for controlling the switching means to turn on from application of the electric signal until the output voltage falls to a prescribed level.

20. An apparatus as claimed in claim 19, wherein the control circuit means comprises a first transistor device responsive to the electric signal for effecting on/off control, a second transistor device provided between the first transistor device and the switching means, and a diode device for level shifting the output voltage from the capacitor and applying it to a control input of the second transistor device, the first and second transistor devices turning on and the switching means being controlled to on state when the first transistor device is turned on by the electric signal and the level of the output voltage is equal to or larger than a prescribed value larger than the value of the level shift by the diode device.

* * * * *